US010237649B2

(12) United States Patent
Nongpiur

(10) Patent No.: US 10,237,649 B2
(45) Date of Patent: Mar. 19, 2019

(54) DIRECTIONAL MICROPHONE DEVICE AND SIGNAL PROCESSING TECHNIQUES

(71) Applicant: Google LLC, Mountain View, CA (US)

(72) Inventor: Rajeev Conrad Nongpiur, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/844,847

(22) Filed: Dec. 18, 2017

(65) Prior Publication Data

US 2018/0124510 A1 May 3, 2018

Related U.S. Application Data

(62) Division of application No. 15/207,707, filed on Jul. 12, 2016, now Pat. No. 9,860,636.

(51) Int. Cl.
*H04R 3/00* (2006.01)
*H04R 1/32* (2006.01)
(Continued)

(52) U.S. Cl.
CPC ..... *H04R 3/005* (2013.01); *H04R 1/222* (2013.01); *H04R 1/326* (2013.01); *H04R 1/02* (2013.01); *H04R 1/04* (2013.01); *H04R 1/342* (2013.01); *H04R 1/38* (2013.01); *H04R 1/406* (2013.01); *H04R 5/027* (2013.01);
(Continued)

(58) Field of Classification Search
CPC . H04R 3/00; H04R 3/005; H04R 3/12; H04R 5/00; H04R 5/04; H04R 5/027; H04R 5/033; H04R 1/02; H04R 1/04; H04R 1/38; H04R 1/222; H04R 1/326; H04R 1/342; H04R 1/406; H04R 2201/401; H04R 2201/403; H04R 2430/20; H04R 2499/11;
(Continued)

(56) References Cited

U.S. PATENT DOCUMENTS 3,560,668 A 2/1971 Paul-Friedrich
4,308,426 A 12/1981 Kikuchi
(Continued)

OTHER PUBLICATIONS

"Thingiverse", http://www.thingiverse.com/thing:499001, Apr. 29, 2016, p. 4.
(Continued)

*Primary Examiner* — Thang V Tran
(74) *Attorney, Agent, or Firm* — Morris & Kamlay LLP

(57) ABSTRACT

Methods and apparatus relating to microphone devices and signal processing techniques are provided. In an example, a microphone device can detect sound, as well as enhance an ability to perceive at least a general direction from which the sound arrives at the microphone device. In an example, a case of the microphone device has an external surface which at least partially defines funnel-shaped surfaces. Each funnel-shaped surface is configured to direct the sound to a respective microphone diaphragm to produce an auralized multi-microphone output. The funnel-shaped surfaces are configured to cause direction-dependent variations in spectral notches and frequency response of the sound as received by the microphone diaphragms. A neural network can device-shape the auralized multi-microphone output to create a binaural output. The binaural output can be auralized with respect to a human listener.

21 Claims, 13 Drawing Sheets

(51) Int. Cl.

| | |
|---|---|
| ***H04R 1/22*** | (2006.01) |
| *H04R 1/02* | (2006.01) |
| *H04R 1/04* | (2006.01) |
| *H04R 1/34* | (2006.01) |
| *H04R 1/38* | (2006.01) |
| *H04R 1/40* | (2006.01) |
| *H04R 5/027* | (2006.01) |

(52) U.S. Cl.
CPC .. *H04R 2201/401* (2013.01); *H04R 2201/403* (2013.01); *H04R 2430/20* (2013.01); *H04R 2499/11* (2013.01)

(58) Field of Classification Search
CPC .. H04R 25/407; H04R 25/507; H04R 25/552; H04R 2225/43; G06N 3/08
See application file for complete search history.

(56) References Cited

U.S. PATENT DOCUMENTS

| | | | | |
|---|---|---|---|---|
| 5,335,312 | A * | 8/1994 | Mekata | G10L 21/0208 704/202 |
| 5,745,661 | A * | 4/1998 | Koh | G03G 15/70 358/1.14 |
| 5,960,391 | A * | 9/1999 | Tateishi | G10L 21/0272 704/202 |
| 6,851,512 | B2 | 2/2005 | Fox et al. | |
| 9,066,189 | B2 | 6/2015 | Einberger et al. | |
| 9,967,693 | B1 * | 5/2018 | Seamans | H04S 7/306 |
| 2005/0031136 | A1 | 2/2005 | Du et al. | |
| 2008/0212804 | A1 | 9/2008 | Watanabe | |
| 2012/0058816 | A1 * | 3/2012 | Wells | G07F 9/026 463/25 |
| 2012/0243721 | A1 | 9/2012 | Inoda et al. | |
| 2012/0257777 | A1 | 10/2012 | Tanaka et al. | |
| 2017/0295439 | A1 * | 10/2017 | Xu | A61N 1/36032 |
| 2017/0353789 | A1 * | 12/2017 | Kim | H04R 3/005 |

OTHER PUBLICATIONS

Brownlee, "Binaural Blue Stereo Mic with Humans Ears", http://gadgets.boingboing.net/2008/06/16/binaural-blue-stereo.html, Jun. 16, 2008, p. 3.

Inspektor, "Inspektor Gadjet Binaural Dummy Head DIY Microphone", www.inspektorgadjet.com/es/binaural-diy-cabeza-dummy, Apr. 29, 2016, p. 4.

Neumann, "Georg Neumann GmbH", https://www.neumann.com/?lang=en&id=current_microphones&cid=ku100_description, Apr. 29, 2016, p. 2.

* cited by examiner

DIRECTIONAL MICROPHONE DEVICE AND SIGNAL PROCESSING TECHNIQUES

BACKGROUND

There is market demand for sound sensors which have perceptual qualities. Conventional sound sensor devices and related techniques, such as conventional artificial head microphones, also known as a dummy head microphones, must be the size and shape of a human head to properly function, and thus are too large for many modern applications. Further, conventional artificial head microphones are visually unpleasant.

BRIEF SUMMARY

This summary provides a basic understanding of some aspects of the present teachings. This summary is not exhaustive in detail, and is neither intended to identify all critical features, nor intended to limit the scope of the claims.

In an example, provided is a first apparatus. The first apparatus includes a case defining a plurality of openings in an external surface of the case, as well as a plurality of microphones fastened to the case. Each microphone in the plurality of microphones is located adjacent to a respective opening in the plurality of openings. The external surface of the case at least partially defines a plurality of funnel-shaped surfaces configured to cause direction-dependent variations in spectral notches and frequency response of received audio, each of the funnel-shaped surfaces in the plurality of funnel-shaped surfaces has a respective inlet and a respective outlet, and a respective diaphragm of each microphone in the plurality of microphones is located adjacent to the respective outlet of a corresponding funnel-shaped surface. In an example, a pair of microphones in the plurality of microphones are located on substantially opposite sides of the case. In an example, at least a portion of a wall of one or more funnel-shaped surfaces in the plurality of funnel-shaped surfaces has a substantially parabolic cross-section along a respective centerline of the respective one or more funnel-shaped surfaces. In an example, at least a portion of a wall of one or more funnel-shaped surfaces in the plurality of funnel-shaped surfaces has a substantially linearly narrowing cross-section along a respective centerline of the respective one or more funnel-shaped surfaces. In another example, at least a portion of a wall of one or more funnel-shaped surfaces in the plurality of funnel-shaped surfaces has a substantially oval cross-section perpendicular to a respective centerline of the respective one or more funnel-shaped surfaces. In an example, the oval has only one axis of symmetry. In a further example, at least a portion of a wall of one or more funnel-shaped surfaces in the plurality of funnel-shaped surfaces has a substantially elliptical cross-section perpendicular to a respective centerline of the respective one or more funnel-shaped surfaces. In an example, at least a portion of a wall of one or more funnel-shaped surfaces in the plurality of funnel-shaped surfaces has an undulating cross-section along a respective centerline of the respective one or more funnel-shaped surfaces. In an example, the undulating cross-section is asymmetric along the respective centerline of the respective one or more funnel-shaped surfaces. In an example, at least a portion of a respective centerline of one or more funnel-shaped surfaces in the plurality of funnel-shaped surfaces is not straight. In an example, the case is a part of: a camera, a thermostat, a smoke detector, a carbon monoxide detector, a glass break detector, or a combination thereof. In another example, the case is a part of: a mobile device, a computing device, a home automation device, a central remote control base station, an alarm system base station, an alarm system controller, an alarm system sensor, a motion sensor, a door movement sensor, a window movement sensor, a cordless phone base station, a cordless phone, a garage door opener, a lock, a television, a monitor, a clock radio, a home theater system, an air conditioner, a light, a doorbell, a fan, a switch, an electric outlet, a sprinkler controller, a washer, a dryer, a refrigerator, an oven, a stove, or a combination thereof.

In another example, provided is a second apparatus. The second apparatus includes a case defining a plurality of openings in an external surface of the case, as well as a plurality of microphones fastened to the case. Each microphone in the plurality of microphones is located adjacent to a respective opening in the plurality of openings. Further, at least one of: (1) the external surface of the case at least partially defines a spiral ridge substantially around a respective opening in the plurality of openings, where the spiral ridge is configured to cause direction-dependent variations in spectral notches and frequency response of received audio, and a respective diaphragm of a respective microphone in the plurality of microphones is located adjacent to the respective opening in the plurality of openings; or (2) the external surface of the case at least partially defines a spiral groove substantially around the respective opening in the plurality of openings, where the spiral groove is configured to cause direction-dependent variations in spectral notches and frequency response of received audio, and the respective diaphragm of the respective microphone in the plurality of microphones is located adjacent to the respective opening in the plurality of openings. In an example, a pair of microphones in the plurality of microphones are fastened on substantially opposite sides of the case. In an example, the spiral ridge is substantially oval-shaped. In another example, the spiral ridge is substantially elliptical. In an example, the case is a part of: a camera, a thermostat, a smoke detector, a carbon monoxide detector, a glass break detector, or a combination thereof. In another example, the case is a part of: a mobile device, a computing device, a home automation device, a central remote control base station, an alarm system base station, an alarm system controller, an alarm system sensor, a motion sensor, a door movement sensor, a window movement sensor, a cordless phone base station, a cordless phone, a garage door opener, a lock, a television, a monitor, a clock radio, a home theater system, an air conditioner, a light, a doorbell, a fan, a switch, an electric outlet, a sprinkler controller, a washer, a dryer, a refrigerator, an oven, a stove, or a combination thereof.

Methods and apparatus relating to a directional microphone device and signal processing techniques are provided. In an example, a first method for processing neural network training data is provided. The first method includes producing neural network training data by capturing first data by receiving audio with a multi-microphone device having at least two mechanical filters external to at least two respective microphones. The first data describes effects, due to one or more audio diffraction patterns about the mechanical filter, of one or more variations in notch frequency relative to a direction between a sound source and the multi-microphone device. The producing the neural network training data also includes capturing second data by receiving the audio with a simulated human head microphone device. The second data describes effects of one or more audio diffraction patterns around the simulated human head microphone device. The producing the neural network training data also includes creating training data, including neural network coefficients, based on one or more differences between the first data and the second data. The first method also includes recording the neural network training data. In an example, the at least two mechanical filters create audio spectral variations which vary with azimuth, elevation, or both. In an example, the at least two mechanical filters create audio spectral notches which vary with azimuth, elevation, or both. In an example, the capturing the first data includes, while audio is provided by a fixed-location audio producing-device, moving the multi-microphone device. In an example, the capturing the first data includes, while audio is provided to the multi-microphone device by an audio producing-device, moving the audio producing-device. In another example, the capturing the second data includes, while audio is provided by a fixed-location audio producing-device, moving the simulated human head microphone device. In a further example, the capturing the second data includes, while audio is provided to the simulated human head microphone device by an audio producing-device, moving the audio producing-device. In another example, the recording the neural network training data includes recording the neural network training data on a cloud-computing storage device.

In a further example, provided is a first non-transitory computer-readable medium, comprising second processor-executable instructions stored thereon. The processor-executable instructions are configured to cause a processor to initiate executing one or more parts of the first method. The first non-transitory computer-readable medium can be integrated with a device, such as a security system.

In an example, a second method for processing an auralized multi-microphone input is provided. The second method includes receiving neural network training data which is auralized with respect to a specific device, as well as receiving an auralized multi-microphone input. The auralized multi-microphone input is auralized with respect to a specific device which is not a simulated external human head. The second method includes applying the neural network training data to a neural network, as well as creating a binaural output by device-shaping the received auralized multi-microphone input with the neural network. The binaural output is auralized with respect to a human listener. In an example, the neural network weights and combines components of the auralized multi-microphone input to create the binaural output. In another example, the second method includes sending the binaural output to a binaural sound-reproducing device. In an example, the receiving the neural network training data includes receiving the neural network training data from a cloud-computing storage device, receiving the auralized multi-microphone input from the cloud-computing storage device, or both.

In a further example, provided is a second non-transitory computer-readable medium, comprising second processor-executable instructions stored thereon. The processor-executable instructions are configured to cause a processor to initiate executing one or more parts of the second method. The second non-transitory computer-readable medium can be integrated with a device, such as a security system.

The foregoing broadly outlines some of the features and technical advantages of the present teachings so the detailed description and drawings can be better understood. Additional features and advantages are also described in the detailed description. The conception and disclosed examples can be used as a basis for modifying or designing other devices for carrying out the same purposes of the present teachings. Such equivalent constructions do not depart from the technology of the teachings as set forth in the claims. The inventive features characteristic of the teachings, together with further objects and advantages, are better understood from the detailed description and the accompanying drawings. Each of the drawings is provided for the purpose of illustration and description only, and does not limit the present teachings.

BRIEF DESCRIPTION OF THE DRAWINGS

The accompanying drawings, which are included to provide a further understanding of the disclosed subject matter, are incorporated in and constitute a part of this specification. The drawings also illustrate examples of the disclosed subject matter and together with the detailed description serve to explain the principles of examples of the disclosed subject matter. No attempt is made to show structural details in more detail than are necessary for a fundamental understanding of the disclosed subject matter and various ways in which the disclosed subject matter can be practiced.

Figure 1:
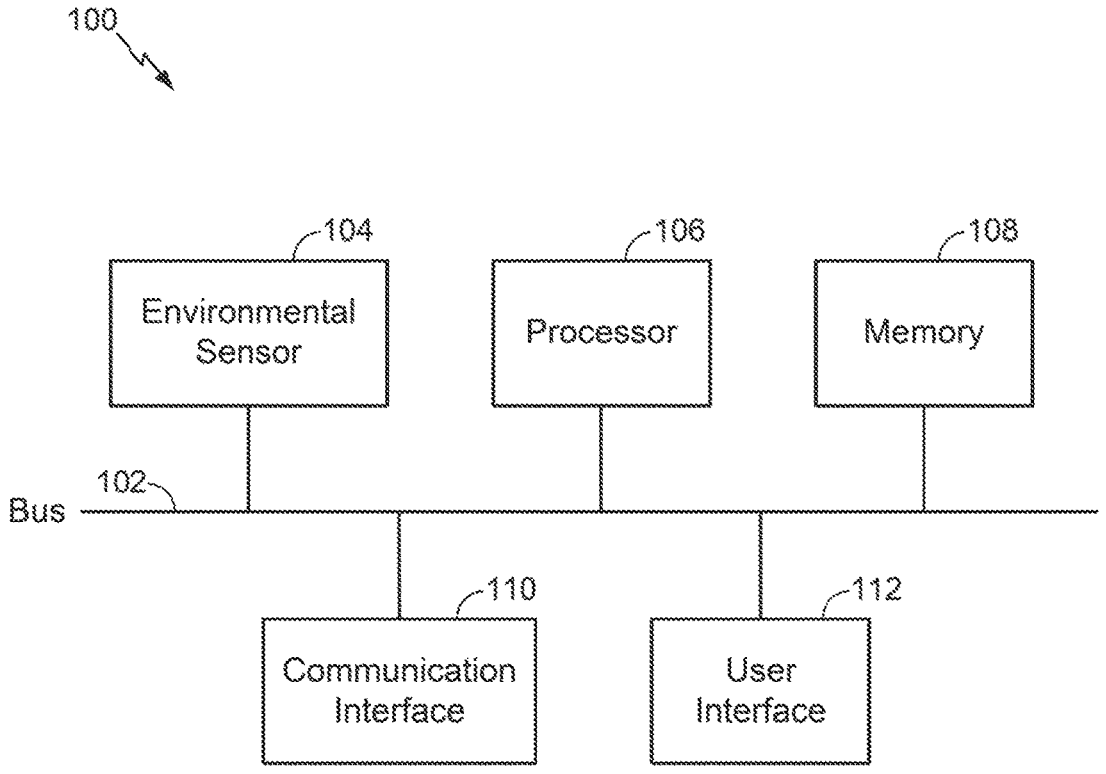
FIG. 1 shows an example sensor, according to an example of the disclosed subject matter.

In accordance with common practice, features depicted by the drawings may not be drawn to scale. Accordingly, dimensions of the depicted features may be arbitrarily expanded or reduced for clarity. In accordance with common practice, some of the drawings are simplified for clarity. Thus, the drawings may not depict all components of a particular apparatus or method. Further, like reference numerals denote like features throughout the specification and figures.

DETAILED DESCRIPTION

Methods and apparatus relating to directional microphone devices and signal processing techniques are provided. In an example, a case of a microphone device has an external surface which at least partially defines one or more funnel-shaped surfaces. Each funnel-shaped surface is configured to direct sound to a respective microphone diaphragm to produce an auralized multi-microphone output. The funnel-shaped surfaces are configured to cause direction-dependent variations in spectral notches and frequency response of the sound as respectively received by the microphone diaphragms. A neural network can device-shape the auralized multi-microphone output to create a binaural output. The binaural output can be auralized with respect to a human listener, thus enhancing an ability to perceive at least a general direction from which the sound arrives at the microphone device.

Humans sense a single combined audio image originating from one or more specific directions. The single combined audio image is a combination of what human ears receive—two similar sounds having (1) a slight time delay; and (2) direction-dependent variations in both spectral notches and frequency response of the sound. The two similar sounds received by the ears are also affected by an environment in which the sound travels, and can include environmental effects due to reflection, diffraction, scattering, or a combination thereof. The two similar sounds received by the ears are also affected by the shape of a human head, including the shape of the ears.

As used herein, "binaural" can be defined as "involving two ears." A binaural recording can be made using a multi-microphone device, such as those provided herein. The multi-microphone device imitates effects on received sound due to a shape of a human head, shape of ears, head-related transfer functions (HRTFs), and the like. The binaural recording, when replayed through headphones, provides a human listener with an audio image. The audio image enables substantially detecting the received sound, substantially localizing one or more sound sources relative to the multi-microphone device, substantially detecting depth of field (distance) of the received sound, substantially recognizing the received sound, or a combination thereof.

The substantially localizing the one or more sound sources can include substantially determining elevation relative to the multi-microphone device and azimuth relative to the multi-microphone device. Determining the elevation can include determining the one or more sound sources' location (s) are higher, lower, or having substantially the same height as the multi-microphone device. Determining the azimuth can include determining the one or more sound sources' location(s), relative to the multi-microphone device, both left-to-right and front-to-back.

In an example, a binaural recording need not be made, and the binaural audio output from the multi-microphone device can be listened to in a substantially "live" manner with the headphones, which provides substantially similar results as listening to a binaural recording.

As used herein, "auralizing" includes reproducing sound based on digital data. Auralizing is similar to visualizing, but uses sound instead of light. Auralizing synthesizes imaginary sound fields, such that a listener experiences sounds substantially similar to those occurring at a place where the digital data was created. The digital data can be recorded and played-back, live-streamed, the like, or a combination thereof.

The provided methods and apparatus provide technological improvements over conventional apparatus and techniques. In an example, a provided microphone device can detect sound, as well as enhance an ability to perceive at least a general direction from which the sound arrives at the microphone device, improve source localization performance, improve sound detection performance, improve sound recognition performance, the like, or a combination thereof. Regarding sound source localization, detection, and recognition, the provided microphone devices are shaped in a manner which improves source localization performance, improves detection performance, and improves recognition performance by the microphone device, relative to conventional devices. Regarding spatial sound perception, the provided microphone devices and techniques can derive binaural signals without requiring an artificial head, and can derive the binaural signals using a microphone device which is dimensionally smaller than an artificial head, relative to conventional devices. This size advantage can enable the microphone device to be integrated into a sensor, such as a smoke alarm, a camera, a smart home sensor, the like, or a combination thereof.

In an example, the microphone device can be integrated with a sensor, as is described with reference to FIG. 1.

FIG. 1 shows an example sensor 100, which includes a specific physical sensor configured to obtain information about the physical sensor's environment. The example sensor 100 can include hardware in addition to the specific physical sensor. The sensor 100 can include a bus 102 configured to enable data communication between couple major components of the sensor 100, such as an environmental sensor 104, a processor 106, a memory 108, a communication interface 110, a user interface 112, the like, or a combination thereof. One or more components of the sensor 100 can be implemented in a single physical arrangement, such as where multiple components are implemented on a single integrated circuit. Sensors can include other components, and/or may not include all of the illustrative components shown.

The example sensor 100 can be a part of, or include: a camera, a thermostat, a smoke detector, a carbon monoxide detector, a glass break detector, a mobile device, a computing device, a home automation device, a central remote control base station, an alarm system base station, an alarm system controller, an alarm system sensor, a motion sensor, a door movement sensor, a window movement sensor, a cordless phone base station, a cordless phone, a garage door opener, a lock, a television, a monitor, a clock radio, a home theater system, an air conditioner, a light, a doorbell, a fan, a switch, an electric outlet, a sprinkler controller, a washer, a dryer, a refrigerator, an oven, a stove, the like, or a combination thereof.

The environmental sensor 104 can be a sensor as described herein, such as a sound-sensing microphone device. The environmental sensor 104 can obtain a corresponding type of information about the environment in which the environmental sensor 104 is located.

The processor 106 can receive and analyze data obtained by the environmental sensor 104, can control operation of other components of the sensor 100, and can process communication between the sensor 100 and other devices. The processor 106 can execute instructions stored in a memory 108. The processor 106 can be a general purpose processor, an Application Specific Integrated Circuit (ASIC), a microprocessor, a microcontroller, a digital signal processor, a field programmable gate array, a programmable logic device, an application-specific integrated circuit, a controller, a non-generic special-purpose processor, a state machine, a gated logic device, a discrete hardware component, a dedicated hardware finite state machine, the like, or a combination thereof.

The memory 108 can store environmental data obtained by the environmental sensor 104. The memory 108 can be a Random Access Memory (RAM), a Read Only Memory (ROM), flash RAM, a computer-readable storage medium, the like, or a combination thereof.

A communication interface 110, such as a Wi-Fi, Bluetooth®, or other wireless interface, Ethernet, other local network interface, the like, or a combination thereof can be configured to enable communication by the sensor 100 with other devices. The communication interface 110 can be configured to provide a connection to a remote device via a wired or wireless connection. The communication interface 110 can provide the connection using any suitable technique and protocol as will be readily understood by one of skill in the art, including digital cellular telephone, Wi-Fi, Bluetooth®, near-field communications (NFC), the like, or a combination thereof. For example, the communication interface 110 can enable the sensor 100 to communicate with a computer via one or more local, wide-area, or other communication networks, as described in further detail herein. The communication interface 110 can include a receiver, a transmitter, a transceiver, the like, or a combination thereof. One or more antennas can be coupled to the communication interface 110 to enable the communication interface 110 to engage in wireless communications.

An optional user interface (UI) 112 can provide information to, and/or receive input from, a user of the sensor 100. The UI 112 can be configured to couple to one or more controllers. The UI 112 can be configured to couple to one or more user input devices, such as a keyboard, a mouse, a touch screen, the like, or a combination thereof. The UI 112 can include, for example, a speaker to output an audible alarm when an event is detected by the sensor 100. The UI 112 can include a light (e.g., a light-emitting diode) configured to be activated when an event is detected by the sensor 100. The UI 112 can have relatively minimal features (e.g., a limited-output display), or the UI 112 can be a full-featured interface (e.g., a touchscreen).

Figure 2A:
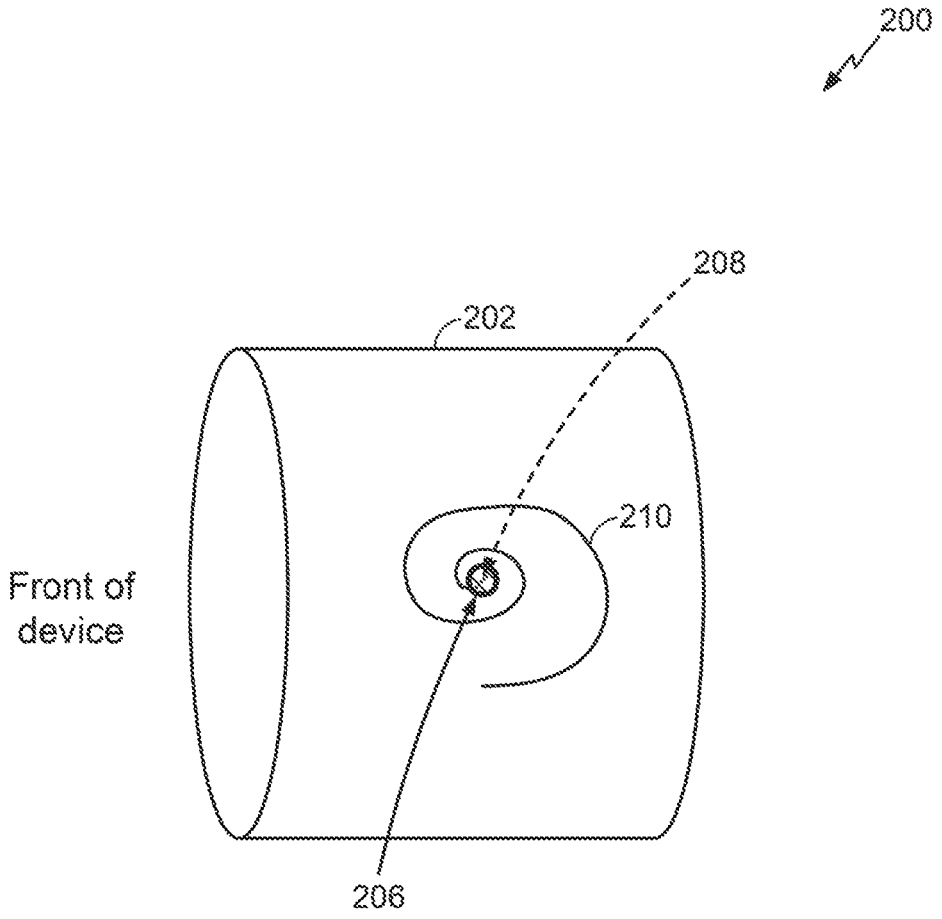
FIG. 2A shows an example microphone device including a case defining a ridge, according to an example of the disclosed subject matter.
Figure 2B:
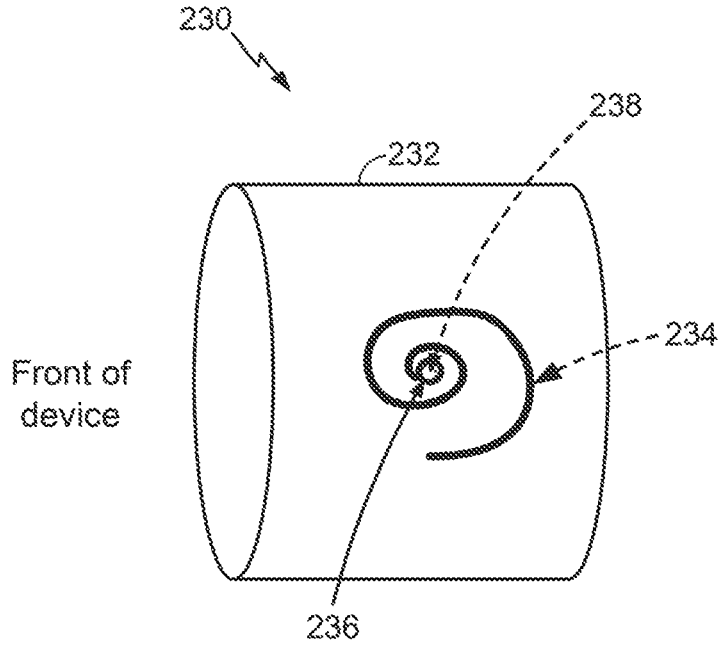
FIG. 2B shows another example microphone device including a case defining a groove, according to an example of the disclosed subject matter.
Figure 2C:
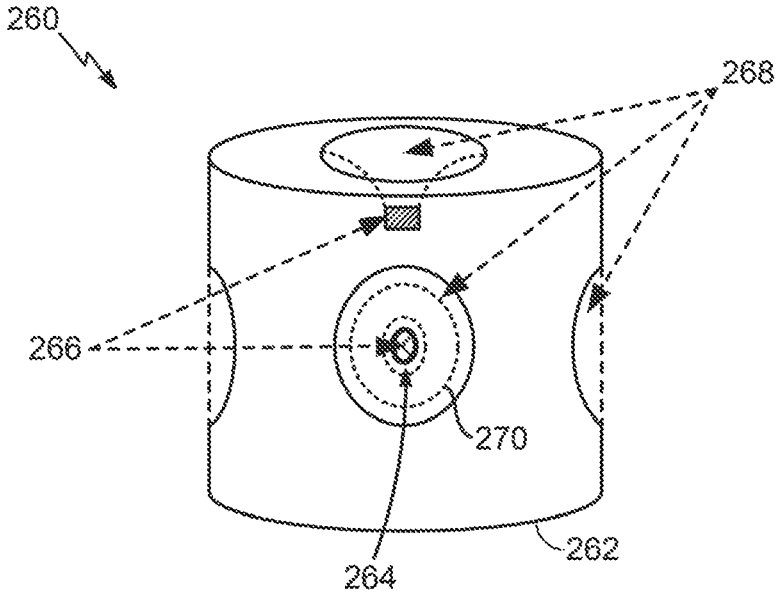
FIGS. 2C-2J show example microphone devices including cases defining respective openings, according to examples of the disclosed subject matter.

FIGS. 2A, 2B, and 2C respectively show example first, second, and third microphone devices 200, 230, 260, each of which have a respective mechanical filter. FIGS. 2D-2J depict variations of the example microphone device 260. The numbers of elements and the orientations of elements depicted in FIGS. 2A-2J are illustrative, and not limiting.

FIG. 2A shows the example first microphone device 200 including a case 202 defining a ridge 204. The first microphone device 200 can be a portion of the sensor 100. The case 202 defines an opening 206 in a plurality of openings in an external surface of the case 202. The first microphone device 200 also has a plurality of microphones fastened to (e.g., inside) the case 202. A microphone 208 in the plurality of microphones is located adjacent to the respective opening 206. In an example, a pair of microphones in the plurality of microphones 208 can be fastened on substantially opposite sides of the case 202, where each microphone 208 is located adjacent to a respective opening in the plurality of openings. In a further example, the case 202 is shaped in a manner which, at least in part, resembles a human head.

In an example, the external surface of the case 202 at least partially defines a ridge 204 substantially around a respective opening 206 in the plurality of openings. The ridge 204 is configured to cause direction-dependent variations in spectral notches and frequency response of audio received by a respective diaphragm of a respective microphone 208 located adjacent to the respective opening 206 in the plurality of openings.

The ridge 204 is raised relative to the surface of the case 202. The ridge 204 can be integrally formed with the surface of the case 202. The ridge 204 can be substantially spiral-shaped, substantially oval-shaped, substantially elliptical, substantially circular, or a combination thereof. An end of the ridge 204 can originate substantially at the respective opening 206. An end of the ridge 204 can originate substantially adjacent to the respective opening 206.

A radius of the ridge 204, substantially centered at the respective opening, can vary, either constantly or variably, along at least a portion of the ridge 204. The radius of the ridge 204 can expand or contract along at least a portion of the ridge 204.

The ridge 204 need not have a continuous path. The ridge 204 can have a disrupted path. The ridge 204 can have a "broken" path where the ridge 204 defines a gap.

In an example, the ridge 204 can have a substantially constant height beyond the surface of the case 202. In another example, the height of the ridge 204 can vary along the path of the ridge 204.

FIG. 2B shows the example second microphone device 230 including a case 232 defining a groove 234. The second microphone device 230 can be a portion of the sensor 100. The case 232 defines an opening 236 in a plurality of openings in an external surface of the case 232. The second microphone device 230 also has a plurality of microphones fastened to (e.g., inside) the case 232. A microphone 238 in the plurality of microphones is located adjacent to the respective opening 236. In an example, a pair of the microphones 238 in the plurality of microphones can be fastened on substantially opposite sides of the case 232, where each microphone 238 is located adjacent to a respective opening in the plurality of openings.

In an example, the external surface of the case 232 at least partially defines the groove 234 substantially around a respective opening 236 in the plurality of openings. The groove 234 is configured to cause direction-dependent variations in spectral notches and frequency response of audio received by a respective diaphragm of a respective microphone 238 located adjacent to the respective opening 236 in the plurality of openings.

The groove 234 can be located within the surface of the case 202. The groove 234 can be integrally formed with the surface of the case 202. A path of the groove 234 can be substantially spiral-shaped, substantially oval-shaped, substantially elliptical, substantially circular, substantially helical, or a combination thereof. An end of the groove 234 can originate substantially at the respective opening 236 in the plurality of openings. An end of the groove 234 can originate substantially adjacent to the respective opening 236 in the plurality of openings.

A radius of the groove 234, substantially centered at the respective opening 236, can vary, either constantly or variably, along at least a portion of the path of the groove 234. The radius of the groove 234 can expand or contract, along at least a portion of the path of the groove 234. In an example, the distance between the groove 234 and the respective opening 236, along at least a portion of the path of the groove 234, can increase (constantly or variably), resulting in a spiral path of the groove 234.

The groove 234 need not have a continuous path. The groove 234 can have a disrupted path. The groove 234 can have a "broken" path where the case 232 defines a gap in the groove 234.

In an example, the groove 234 can have a substantially constant depth below the surface of the case 232. In another example, the depth of the groove 234 can vary along the path of the groove 234.

FIG. 2C shows the example third microphone device 260 including a case 262 defining one or more openings 264. The third microphone device 260 can be a portion of the sensor 100. The case 262 defines the opening 264 in a plurality of openings in an external surface of the case 262. The third microphone device 260 also has a plurality of microphones fastened to (e.g., inside) the case 262. A microphone 266 in the plurality of microphones is located adjacent to the respective opening 264. In an example, a pair of microphones in the plurality of microphones can be fastened on substantially opposite sides of the case 262, where each microphone is located adjacent to a respective opening in the plurality of openings.

In an example, the external surface of the case 262 at least partially defines one or more funnel-shaped surfaces 268 (e.g., one or more depressions) in a plurality of funnel-shaped surfaces. The one or more funnel-shaped surfaces 268 are configured to cause direction-dependent variations in spectral notches and frequency response of audio received by a respective diaphragm of the microphone 266. The microphone 266 is located adjacent to a respective opening 264 in a plurality of openings.

In an example, the one or more funnel-shaped surfaces 268 can have an entry which is non-symmetrical. In an example, the one or more funnel-shaped surfaces 268 can have an entry which is symmetrical.

FIGS. 2D-2J depict different configurations of the third microphone device 260.

Figure 2D:
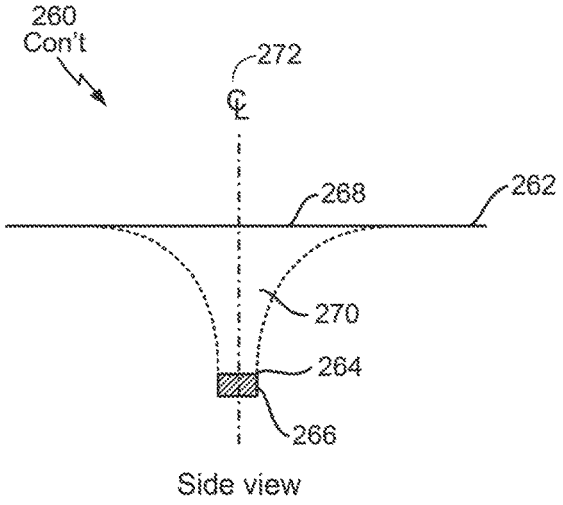

In an example, depicted in FIG. 2D, at least a portion of a wall 270 of the funnel-shaped surface 268 has a substantially parabolic cross-section along a respective centerline 290 of the funnel-shaped surface 268.

Figure 2E:
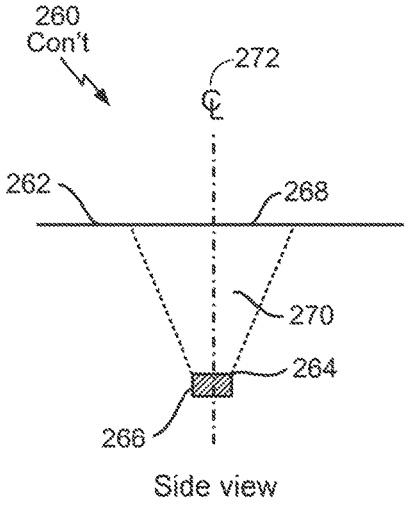

In an example, depicted in FIG. 2E, at least a portion of the wall 270 of the funnel-shaped surface 268 has a substantially linearly narrowing cross-section along the centerline 290 of the funnel-shaped surface 268.

Figure 2F:
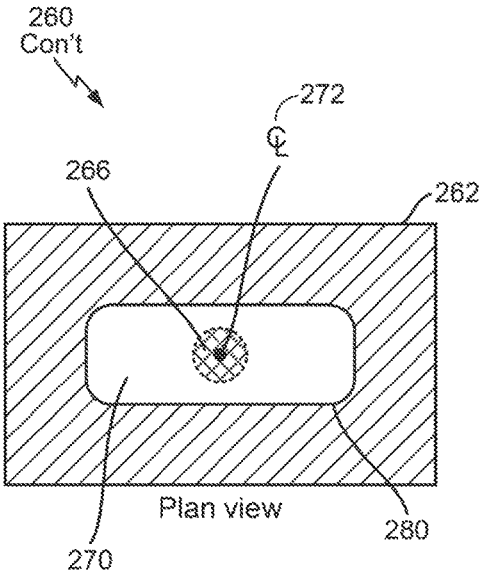

In an example, depicted in FIG. 2F, at least a portion of the wall 270 of the funnel-shaped surface 268 has a substantially oval cross-section perpendicular to the centerline 290 of the funnel-shaped surface 268. In an example, the oval cross-section has only one axis of symmetry.

Figure 2G:
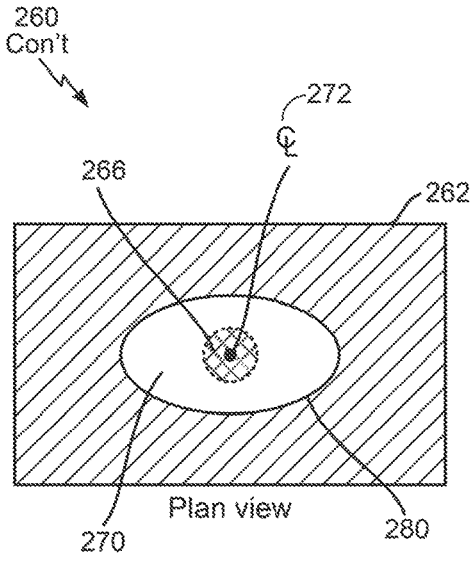

In an example, depicted in FIG. 2G, at least a portion of the wall 270 of the funnel-shaped surface 268 has a substantially elliptical cross-section perpendicular to the centerline 290 of the funnel-shaped surface 268.

Figure 2H:
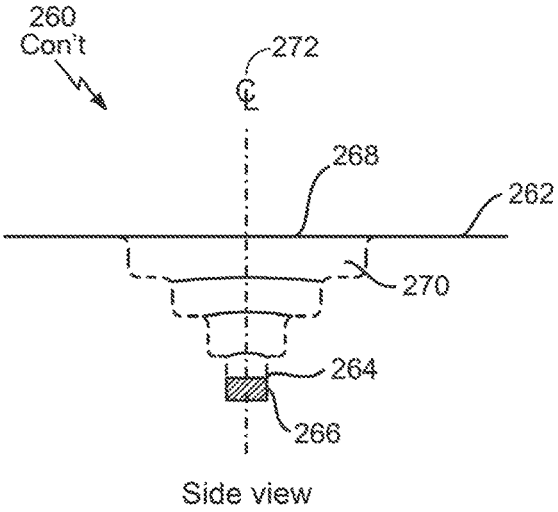

In an example, depicted in FIG. 2H, at least a portion of the wall 270 of the funnel-shaped surface 268 has an undulating cross-section along the centerline 290 of the respective one or more funnel-shaped surfaces. The undulating cross-section can be asymmetric along the centerline 290 of the funnel-shaped surface 268. The number of undulations of the cross-section can be one or more.

Figure 2I:
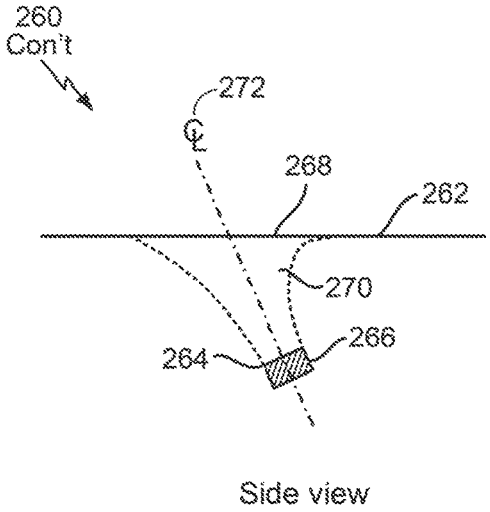

In an example, depicted in FIG. 2I, at least a portion of the centerline 290 of the funnel-shaped surface 268 is at a non-right angle relative to the surface of case 262.

Figure 2J:
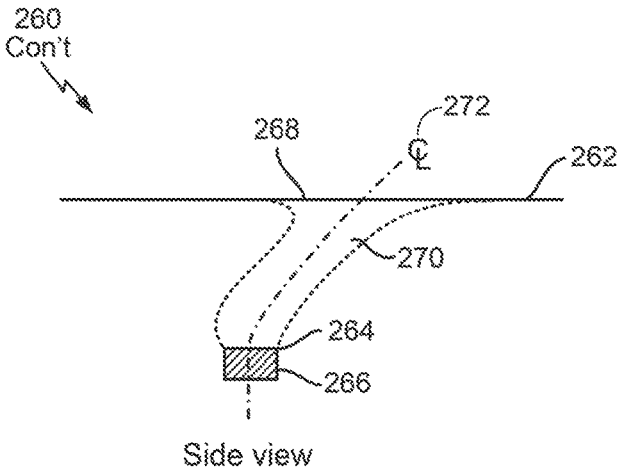

In an example, depicted in FIG. 2J, at least a portion of a respective centerline 290 of the funnel-shaped surface 268 is not straight. In an example, at least a portion of the centerline 290 of the funnel-shaped surface 268 is curved.

Figure 3:
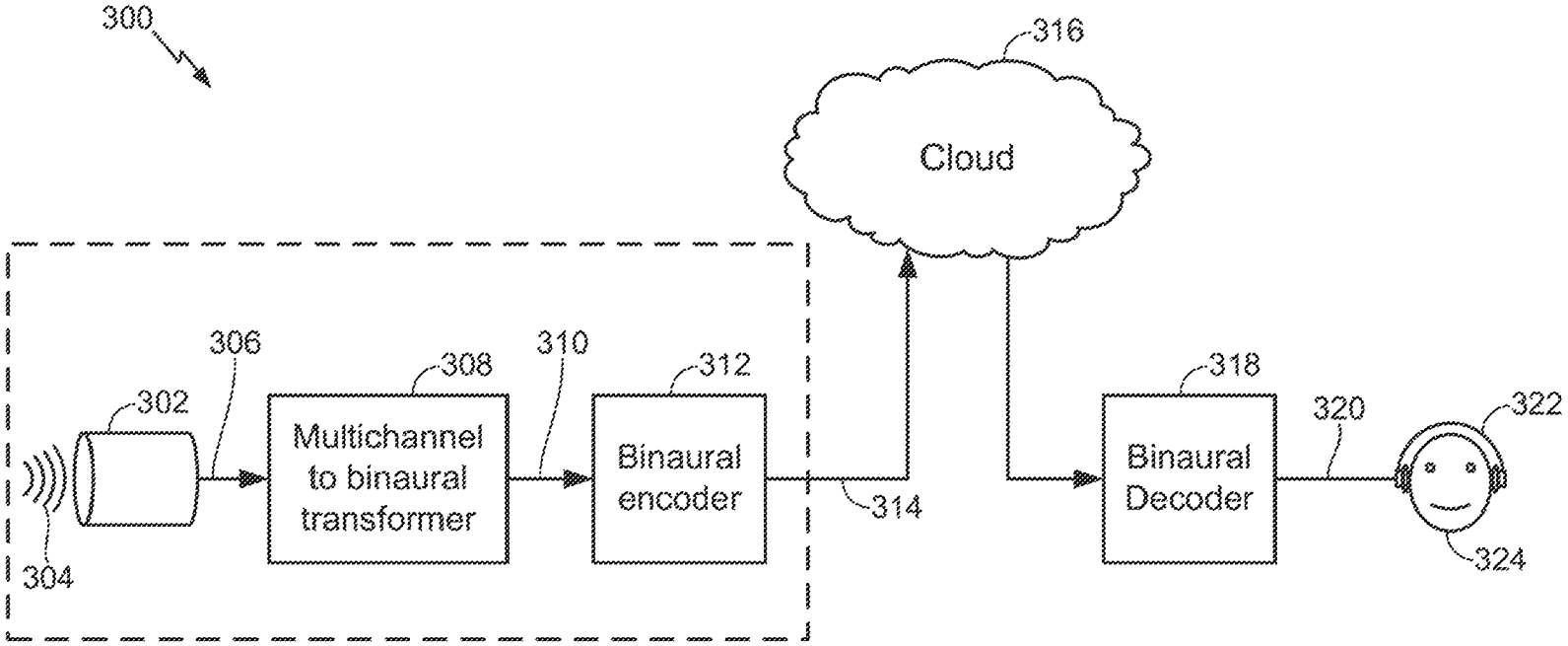
FIG. 3 shows an example overview block diagram of a process for producing and reproducing binaural data, according to an example of the disclosed subject matter.

FIG. 3 shows an example overview block diagram of a process 300 for producing and reproducing binaural data. A multi-microphone device 302, such as, for example, those described with respect to FIGS. 2A-2C can receive incident sound waves 304 and can convert the incident sound waves 304 to one or more multichannel electrical signals 306. In an example, the multi-microphone device 302 can be any sound sensor which is sensitive to sound frequencies associated with human listening (e.g., 20 Hz-20 kHz). A multichannel to binaural transformer 308 can covert the one or more multichannel electrical signals 306 to a binaural signal 310. A binaural encoder 312 can convert the binaural signal to encoded binaural data 314. The binaural data 314 can be sent to a cloud computing device 316. The binaural data 314 can be recorded and stored, for example in a cloud computing-based storage device. Cloud computing enables a user to use a shared pool of computing resources, such as computer hardware, software, the like, or a combination thereof. The computing resources can include a server, a memory, disk storage, a network device, a network, a software application, a computer-based service, a web server, the like, or a combination thereof. In an example, the binaural data 314 can be processed (e.g., forwarded, manipulated, changed, altered, filtered, segmented, the like, or a combination thereof), for example by a cloud computing-based computing resource. The binaural data 314, or a variation thereof, can be sent from the cloud computing device 316 to a binaural decoder 318. The binaural decoder 318 decodes the binaural data into electrical audio signals 320 (e.g., a left signal and a right signal). The electrical audio signals 320 are sent to one or more pairs of headphones 322, where the incident sound waves 304, or a variation thereof, can be listened to by a user 324.

In an example, the multi-microphone device 302 may be a part of a security system's sensor, e.g., sensor 104 of FIG. 1. When the security system alarms, the user 324 can receive an indication of the alarm and can advantageously listen to the environment around the security system's sensor to determine if the environment is occupied, to substantially determine a location of one or more occupants in the environment, to identify an occupant, the like, or a combination thereof.

Figure 4:
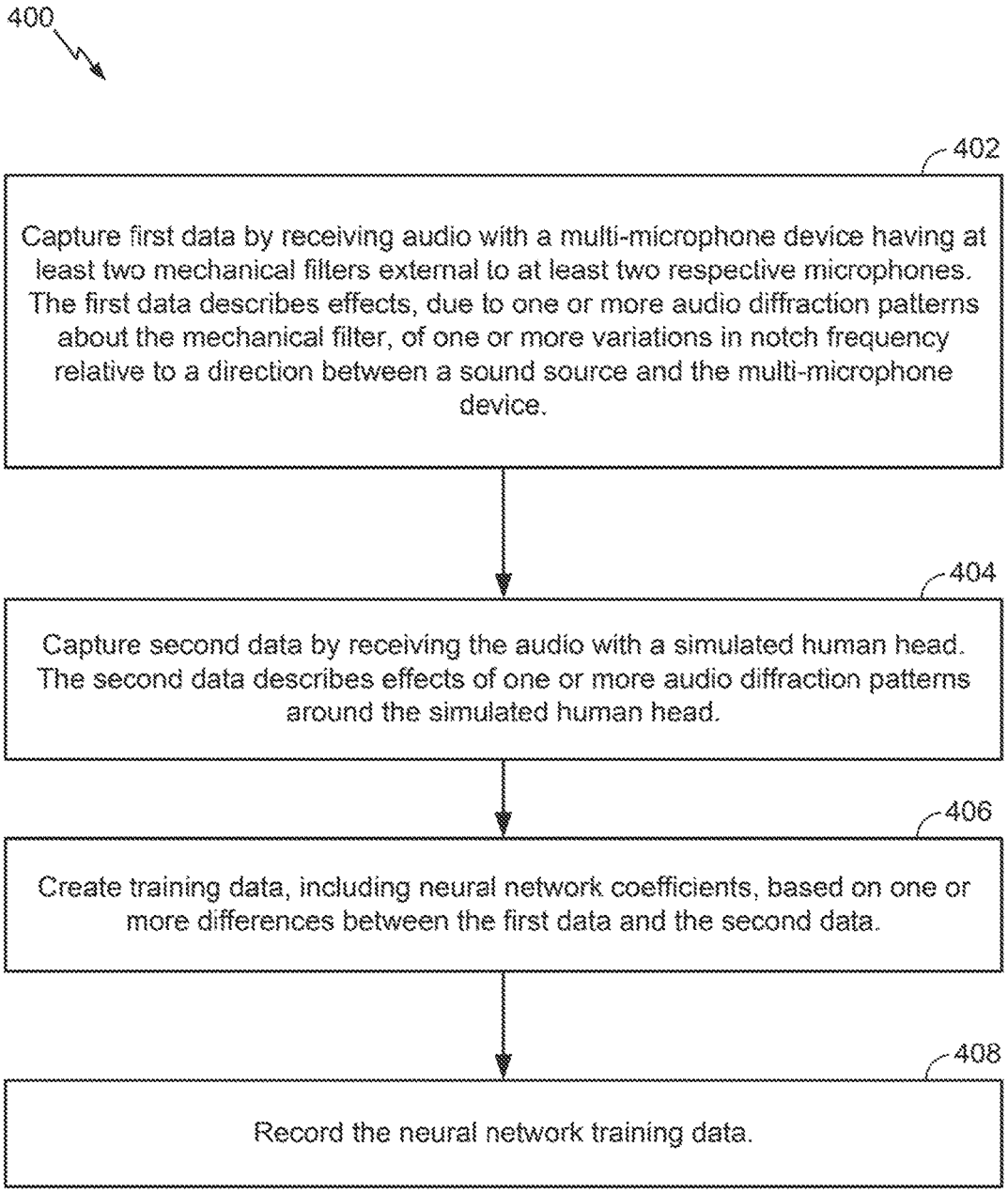
FIG. 4 shows a flowchart depicting an example method for processing neural network training data, according to an example of the disclosed subject matter.
Figure 5A:
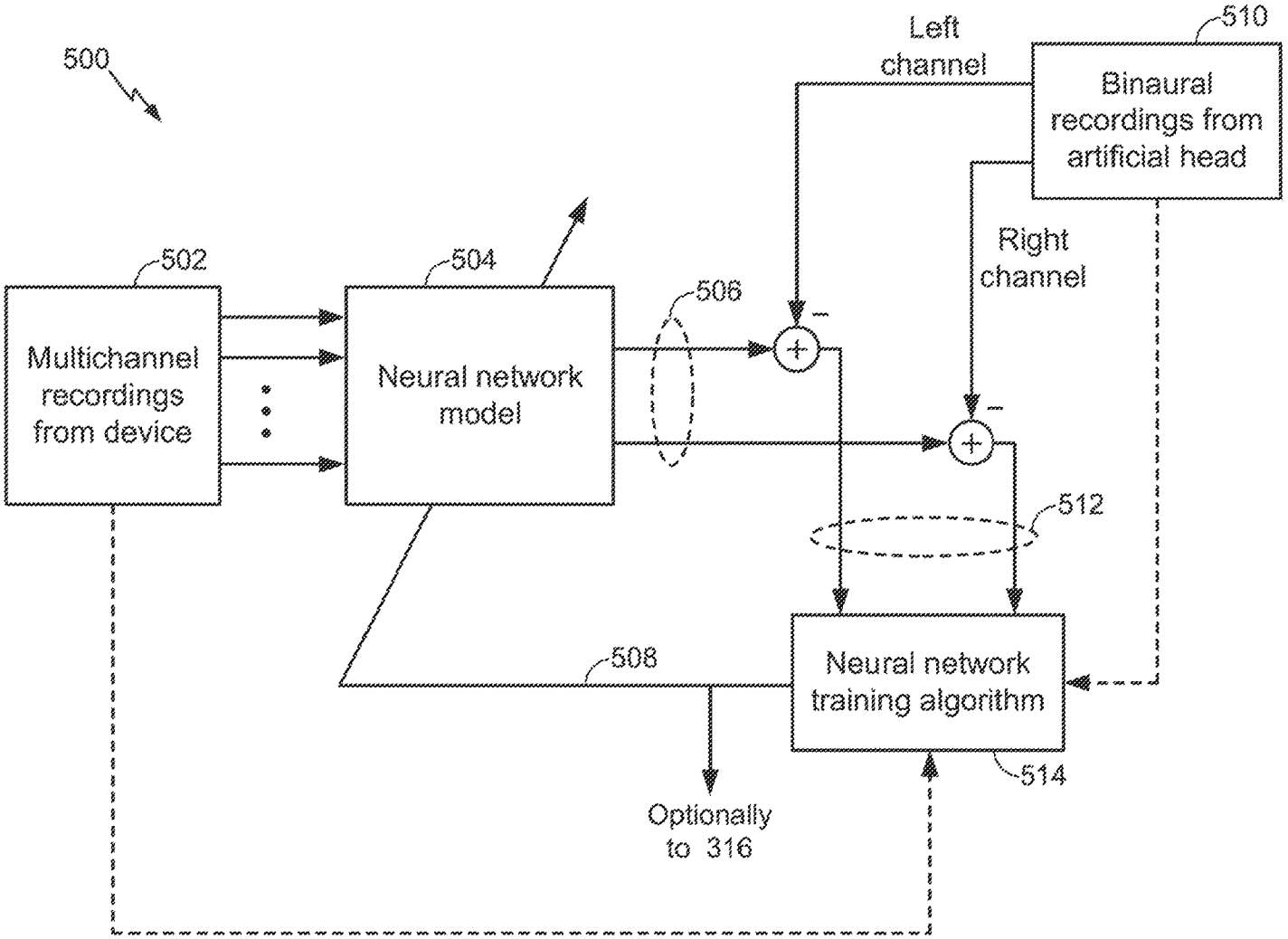
FIG. 5A shows an example block diagram of a device for producing neural network training data, according to an example of the disclosed subject matter.
Figure 5B:
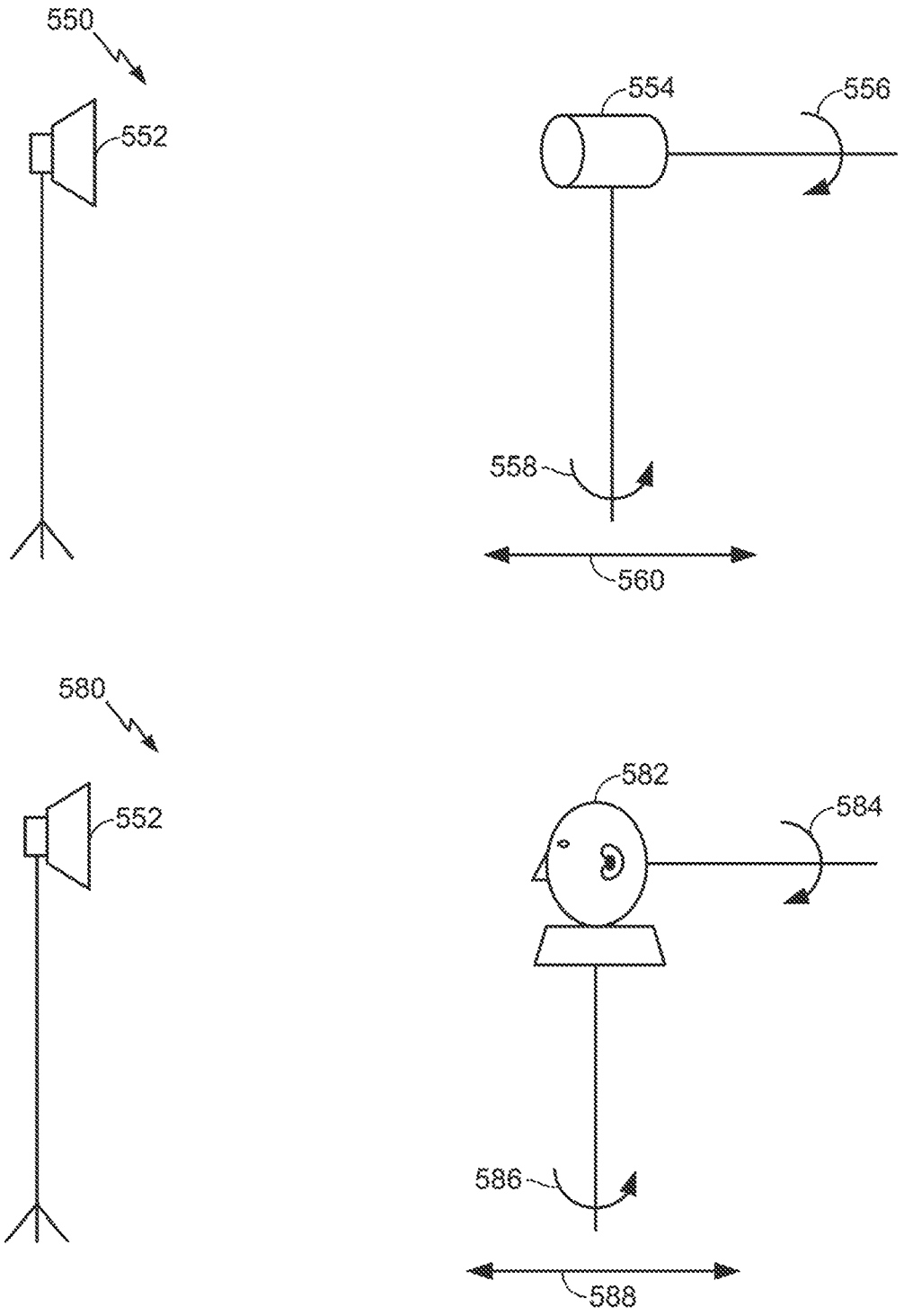
FIG. 5B shows an example spatial arrangement for generating data which can be used to produce neural network training data, according to an example of the disclosed subject matter.

FIG. 4 shows a flowchart depicting an example method 400 for processing neural network training data. At least a portion of the method 400 can be performed at least in part by the processor 106, a controller 708 (described in detail with respect to FIG. 7), a remote system 710 (described in detail with respect to FIG. 7), a processor 804 (described in detail with respect to FIG. 8), a server 908 (described in detail with respect to FIG. 9), a remote platform 912 (described in detail with respect to FIG. 9), the like, or a combination thereof. In an example, at least a portion of the method 400 can be initiated by at least in part by the processor 106, the controller 708, the remote system 710, the processor 804, the server 908, the remote platform 912, the like, or a combination thereof. FIGS. 5A and 5B depict apparatus which can be used to implement at least a portion of the method 400.

The method 400 can advantageously enable device-shaping an auralized multi-microphone output to create a binaural output, as a neural network enables capturing complex diffraction patterns around a shape of a multi-microphone device (e.g., a multi-microphone device described herein, the first microphone device 200, the second microphone device 230, the third microphone device 260, the multi-microphone device 302, the like, or a combination thereof), where the shape effects sound received by one or more microphones of the microphone device. The method 400 can thus advantageously enable enhancing an ability to perceive at least a general direction from which the sound arrives at the microphone device, improve source localization performance, sound detection performance, improve sound recognition performance, the like, or a combination thereof. Accordingly, the method 400 advantageously provides a technological advancement over conventional techniques.

Blocks 402-406 describe examples of ways to produce neural network training data. The production of the neural network training data includes creating training data based on one or more differences between first data and second data. The training data includes neural network coefficients. Generally, the first data is produced with a multi-microphone device, such as those described hereby, having at least two mechanical filters external to at least two respective microphones, and the second data is produced with a simulated human head microphone device.

In block 402, first data is captured by receiving audio with the multi-microphone device. The multi-microphone device has at least two mechanical filters external to at least two respective microphones. While receiving the audio, the multi-microphone device can be located in an anechoic chamber. The at least two mechanical filters can include at least one of the microphone device 200, at least one of the microphone device 230, at least one of the microphone device 260, the like, or a combination thereof. The first data describes effects of one or more variations in notch frequency relative to a direction between a sound source and the multi-microphone device. The variations, and thus the effects, are due to one or more audio diffraction patterns due to (e.g., about) the at least two mechanical filters.

The at least two mechanical filters can create audio spectral variations which vary with azimuth, elevation, or both. The at least two mechanical filters can create audio spectral notches which vary with azimuth, elevation, or both.

The capturing the first data can include, while audio is provided by a fixed-location audio producing-device, moving the multi-microphone device. Moving the multi-microphone device causes specific changes in direction between the fixed-location audio producing-device and the multi-microphone device. This, in turn, causes direction-related variations in notch frequency of sound received at the multi-microphone device, and relative to the direction between the fixed-location audio producing-device and the multi-microphone device. The first data can include first direction data describing the orientation between the fixed-location audio producing-device and the multi-microphone device. The first direction data can be substantially simultaneously recorded to correlate the direction with the direction-related variations in notch frequency. The orientation can include direction, distance, the like, and combinations thereof. The correlation can include correlating changes in direction, changes in distance, the like, and combinations thereof with changes in the notch frequency.

In another example, the capturing the first data can include, while audio is provided to the multi-microphone device by the audio producing-device, moving the audio producing-device. Moving the audio producing-device causes specific changes in direction between the audio producing-device and the fixed-location multi-microphone device. This, in turn, causes direction-related variations in the notch frequency of the sound received at the multi-microphone device, and relative to the direction between the audio producing-device and the fixed-location multi-microphone device. The first data can include the first direction data describing the orientation between the audio producing-device and the fixed-location multi-microphone device. The first direction data can be substantially simultaneously recorded to correlate the direction with the direction-related variations in the notch frequency. The orientation can include direction, distance, the like, and combinations thereof. The correlation can include correlating changes in direction, changes in distance, the like, and combinations thereof with changes in the notch frequency.

In block 404, second data is captured by receiving the audio with the simulated human head microphone device. The second data describes effects of one or more audio diffraction patterns around the simulated human head microphone device. The capturing the second data can include, while audio is provided by a fixed-location audio producing-device, moving the simulated human head microphone device. While receiving the audio, the simulated human head microphone device can be located in the anechoic chamber. Moving the simulated human head microphone device causes specific changes in direction between the fixed-location audio producing-device and the simulated human head microphone device. This, in turn, causes direction-related variations in notch frequency of sound received at the simulated human head microphone device, and relative to the direction between the fixed-location audio producing-device and the simulated human head microphone device. The second data can include second direction data describing the orientation between the fixed-location audio producing-device and the simulated human head microphone device. The second direction data can be substantially simultaneously recorded to correlate the direction with the direction-related variations in notch frequency. The orientation can include direction, distance, the like, and combinations thereof. The correlation can include correlating changes in direction, changes in distance, the like, and combinations thereof with changes in the notch frequency.

In another example, the capturing the second data can include, while audio is provided to the simulated human head microphone device by an audio producing-device, moving the audio producing-device. Moving the audio producing-device causes specific changes in direction between the audio producing-device and the fixed-location simulated human head microphone device. This, in turn, causes direction-related variations in the notch frequency of the sound received at the simulated human head microphone device, and relative to the direction between the audio producing-device and the fixed-location simulated human head microphone device. The second data can include the second direction data describing the orientation between the audio producing-device and the simulated human head microphone device. The second direction data can be substantially simultaneously recorded to correlate the direction with the direction-related variations in the notch frequency. The orientation can include direction, distance, the like, and combinations thereof. The correlation can include correlating changes in direction, changes in distance, the like, and combinations thereof with changes in the notch frequency.

In block 406, the first data is compared to the second data to identify differences in one or more notch frequencies occurring at a substantially similar first direction and second direction. Additional differences in notch frequencies can be determined at other substantially similar first directions and second directions. The identified differences between the first data and the second data can be used to create training data, such as neural network training data. The training data can include, for example, neural network coefficients.

In an example, the neural network training data can include data describing effects on recorded sound by rooms of different sizes, data describing different reverberation times, data generated by an auralization simulator, the like, or a combination thereof.

In block 408, the training data (e.g., the neural network training data) is recorded. The recording training data can include recording the training data on a cloud-computing storage device. In an example, the recording training data can include recording the training data on storage device which is a part of the multi-microphone device. In an example, the recording training data can include recording the training data on storage device which is electrically coupled to the multi-microphone device. In an example, the recording training data can include recording the training data on a computer network storage device.

The foregoing blocks are not limiting of the examples. The blocks can be combined and/or the order can be rearranged, as practicable.

FIG. 5A shows an example block diagram 500 of a device for producing neural network training data. At least a portion of the features described in the block diagram 500 can be performed at least in part by the processor 106, the controller 708, the remote system 710, the processor 804, the server 908, the remote platform 912, the like, or a combination thereof. In an example, at least a portion of the features described in the block diagram 500 can be initiated by at least in part by the processor 106, the controller 708, the remote system 710, the processor 804, the server 908, the remote platform 912, the like, or a combination thereof.

The block diagram 500 includes receiving, retrieving, the like, or a combination thereof of an input of one or more auralized multichannel recordings 502 from a multi-microphone device (e.g., a multi-microphone device described herein, the first microphone device 200, the second microphone device 230, the third microphone device 260, the multi-microphone device 302, the like, or a combination thereof). The auralized multichannel recordings 502 are auralized with respect to a specific multi-microphone device. The auralized multichannel recordings 502 can include the first data described in block 402. The one or more auralized multichannel recordings 502 are input to a neural network model 504.

The neural network model 504 processes the auralized multichannel recordings 502 and creates a binaural output 506 by using neural network training data 508 to device-shape the received auralized multichannel recordings 502. The neural network can weigh and combine components of the auralized multichannel recordings 502 to create the binaural output 506. The processing can include performing a machine-learning technique to determine the neural network training data 508. The binaural output 506 can be auralized with respect to a human listener.

The block diagram 500 includes receiving, retrieving, the like, or a combination thereof of an input of one or more binaural recordings 510 from the simulated human head microphone device. The one or more binaural recordings 510 can include the second data described in block 402.

The binaural output 506 is compared with the one or more binaural recordings 510 to identify differences 512 between the binaural output 506 and the one or more binaural recordings 510. The differences 512 are input to a neural network training algorithm 514. The auralized multichannel recordings 502 can be input to the neural network training algorithm 514. The one or more binaural recordings 510 can be input to the neural network training algorithm 514. The neural network training algorithm 514 creates the neural network training data 508, which can include neural network coefficients used by the neural network model 504. The neural network training algorithm 514 can adjust the neural network coefficients in the neural network training data 508 to reduce the differences 512 to a substantially minimal amount. The neural network coefficients in the neural network training data 508 can be recorded. For example, when the differences 512 are reduced to a substantially minimal amount, the neural network training data 508 are recorded as the neural network training data. The neural network training data 508 can be sent to the cloud computing device 316 for storage and subsequent retrieval. The neural network training data 508 can be recorded and stored, for example in a cloud computing-based storage device.

FIG. 5B shows an example first spatial arrangement 550 and an example second spatial arrangement 580, each of which can be used for respectively generating the first data and the second data, which in turn can be used to produce the neural network training data.

In the first spatial arrangement 550, the capturing the first data can include, while audio is provided by a fixed-location loudspeaker 552, moving a multi-microphone device 554. The multi-microphone device 554 can be a multi-microphone device described herein, the first microphone device 200, the second microphone device 230, the third microphone device 260, the multi-microphone device 302, the like, or a combination thereof. The moving the multi-microphone device 554 causes specific changes in direction between the fixed-location loudspeaker 552 and the multi-microphone device 554. The moving can include a horizontal-axis rotation 556, a vertical axis rotation 558, a distance variation 560, the like, or a combination thereof. The moving, in turn, causes direction-related variations in notch frequency of sound received at the multi-microphone device 554, and relative to the direction between the fixed-location loudspeaker 552 and the multi-microphone device 554. The first data can include the first direction data describing the orientation between the fixed-location loudspeaker 552 and the multi-microphone device 554. The first direction data can be substantially simultaneously recorded to correlate the direction with the direction-related variations in the notch frequency. The orientation can include direction, distance, the like, and combinations thereof. The correlation can include correlating changes in direction, changes in distance, the like, and combinations thereof with changes in the notch frequency.

In the second spatial arrangement 580, the capturing the first data can include, while the audio is provided by the fixed-location loudspeaker 552, moving the simulated human head microphone device 582. The moving the simulated human head microphone device 582 causes specific changes in direction between the fixed-location loudspeaker 552 and the simulated human head microphone device 582. The moving can include a horizontal-axis rotation 584, a vertical axis rotation 586, a distance variation 588, the like, or a combination thereof. The moving, in turn, causes direction-related variations in notch frequency of sound received at the simulated human head microphone device 582, and relative to the direction between the fixed-location loudspeaker 552 and the simulated human head microphone device 582. The second data can include second direction data describing the orientation between the fixed-location loudspeaker 552 and the simulated human head microphone device 582. The second direction data can be substantially simultaneously recorded to correlate the direction with the direction-related variations in the notch frequency. The orientation can include direction, distance, the like, and combinations thereof. The correlation can include correlating changes in direction, changes in distance, the like, and combinations thereof with changes in the notch frequency.

In examples, the audio provided by the fixed-location loudspeaker 552 can include human speech, a sound typically occurring in a home, a sound not typically occurring in a home, a sound occurring in a home during an emergency situation, the like, or a combination thereof.

In an example, the fixed-location loudspeaker 552 is an artificial mouth.

In an example, the first spatial arrangement 550 and the second spatial arrangement 580 are simultaneously collocated such that the first data and the second data are simultaneously recorded (i.e., time-aligned).

Figure 6:
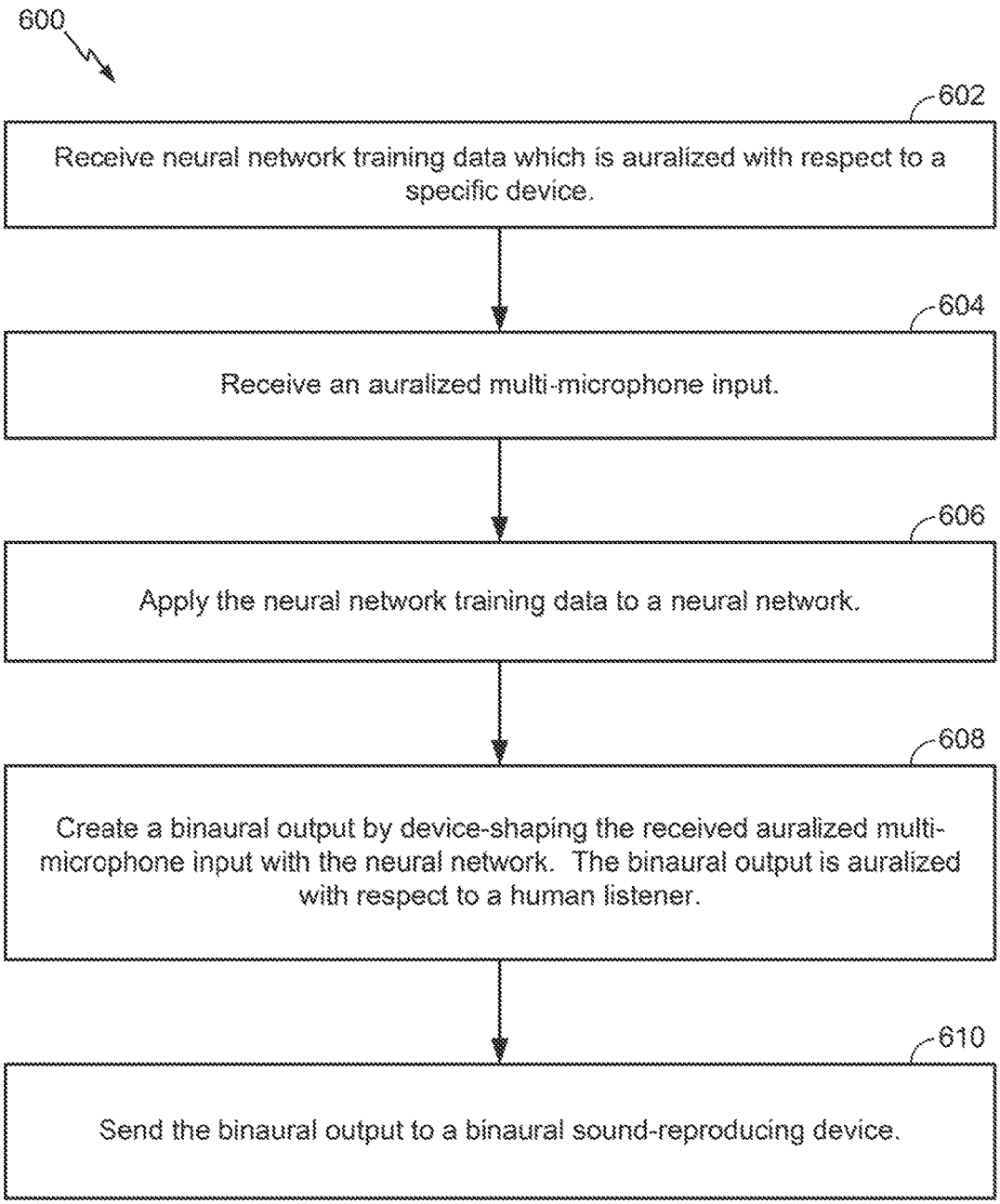
FIG. 6 shows a flowchart depicting another example method for processing neural network training data, according to an example of the disclosed subject matter.

FIG. 6 shows a flowchart depicting another example method 600 for processing neural network training data. At least a portion of the method 600 can be performed at least in part by the processor 106, the controller 708, the remote system 710, the processor 804, the server 908, the remote platform 912, the like, or a combination thereof. In an example, at least a portion of the method 600 can be initiated by at least in part by the processor 106, the controller 708, the remote system 710, the processor 804, the server 908, the remote platform 912, the like, or a combination thereof.

The method 600 can advantageously enable device-shaping an auralized multi-microphone output to create a binaural output. The method 600 can advantageously enable enhancing an ability to perceive at least a general direction from which the sound arrives at the microphone device. Thus, the method 600 advantageously provides a technological advancement over conventional techniques.

In block 602, training data (e.g., neural network training data) is received (e.g., via a live-stream), retrieved, the like, or a combination thereof. The training data is auralized with respect to a specific device, such as the multi-microphone device 302. In an example, receiving the neural network training data can include receiving the neural network training data from a cloud-computing storage device. In an example, the receiving the neural network training data can include receiving the neural network training data from the storage device which is a part of the multi-microphone device. In an example, the receiving the neural network training data can include receiving the neural network training data from the storage device which is electrically coupled to the multi-microphone device 302. In an example, the receiving the neural network training data can include receiving the neural network training data from the computer network storage device.

In block 604, an auralized multi-microphone input is received (e.g., via a live-stream), retrieved, the like, or a combination thereof. In an example, the auralized multi-microphone input is auralized with respect to a specific device which is not a simulated external human head. In an example, receiving the auralized multi-microphone input can include receiving the auralized multi-microphone input from a cloud-computing storage device. In an example, the receiving the auralized multi-microphone input can include receiving the auralized multi-microphone input from the storage device which is a part of the multi-microphone device. In an example, the receiving the auralized multi-microphone input can include receiving the auralized multi-microphone input from the storage device which is electrically coupled to the multi-microphone device 302. In an example, the receiving the auralized multi-microphone input can include receiving the auralized multi-microphone input from the computer network storage device.

In block 606, the training data is applied to a neural network.

In block 608, a binaural output is created by device-shaping the received auralized multi-microphone input with the neural network. The binaural output can be auralized with respect to a human listener. The neural network can weight components of the auralized multi-microphone input and combine components of the auralized multi-microphone input to create the binaural output.

In optional block 610, the binaural output is sent to a binaural sound-reproducing device. The binaural sound-reproducing device can be a pair of headphones, earphones, earbuds, a sound-reproducing device which is located adjacent to a human's ears when reproducing sound, or a combination thereof.

The foregoing blocks are not limiting of the examples. The blocks can be combined and/or the order can be rearranged, as practicable.

Figure 7:
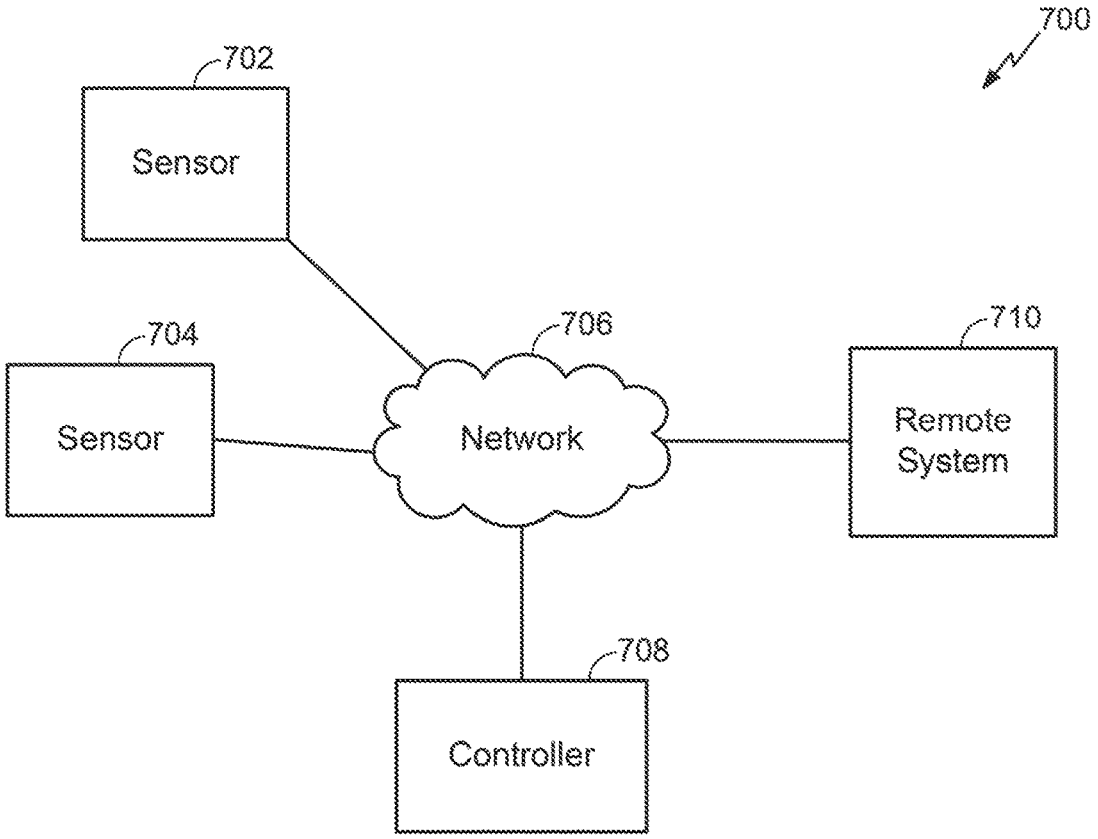
FIG. 7 shows an example of a sensor system, according to an example of the disclosed subject matter.

FIG. 7 shows an example of a sensor network 700, which can be implemented over any suitable wired and/or wireless communication networks. One or more sensors 702, 704 can communicate via a local network 706, such as a Wi-Fi or other suitable network, with each other and/or with the controller 708.

In general, a sensor, such as the sensors 702, 704, is any device that can obtain information about the sensor's environment. The sensors 702, 704 can include a photodiode-augmented IR motion sensor. Sensors can be described by the type of information they collect. Sensor types can include motion, smoke, carbon monoxide, proximity, temperature, time, physical orientation, acceleration, location, entry, presence, pressure, light, sound, and the like. A sensor also can be described in terms of the particular physical device that obtains the environmental information. An accelerometer can obtain acceleration information, and thus can be used as a general motion sensor and/or an acceleration sensor. A sensor also can be described in terms of the specific hardware components used to implement the sensor. For example, a temperature sensor can include a thermistor, thermocouple, resistance temperature detector, integrated circuit temperature detector, or a combination thereof. A sensor also can be described in terms of a function or functions the sensor performs within the sensor network 700, such as a smart home environment. For example, a sensor can operate as a security sensor when the sensor is used to determine security events such as unauthorized entry. A sensor can operate with different functions at different times, such as where a motion sensor is used to control lighting in a smart home environment when an authorized user is present, and is used to alert to unauthorized or unexpected movement when no authorized user is present, or when an alarm system is in an armed state, or the like. In some cases, a sensor can operate as multiple sensor types sequentially or concurrently, such as where a temperature sensor is used to detect a change in temperature, as well as the presence of a person or animal. A sensor also can operate in different modes at the same or different times. For example, a sensor can be configured to operate in one mode during the day and another mode at night. As another example, a sensor can operate in different modes based upon a state of a home security system or a smart home environment, or as otherwise directed by such a system. A sensor can include multiple sensors or sub-sensors, such as where a position sensor includes both a global positioning sensor (GPS) as well as a wireless network sensor, which provides data that can be correlated with known wireless networks to obtain location information. Multiple sensors can be arranged in a single physical housing, such as where a single device includes movement, temperature, magnetic, and/or other sensors. Such a housing also can be referred to as a sensor or a sensor device. For clarity, sensors are described with respect to the particular functions they perform and/or the particular physical hardware used, when such specification is necessary for understanding of the examples disclosed hereby.

In some configurations, two or more sensors can generate data which can be used by a processor to generate a response and/or infer a state of an environment. For example, an ambient light sensor can determine a light intensity (e.g., darkness) (e.g., less than 60 lux) in a room in which the ambient light sensor is located. A microphone can detect a sound above a set threshold, such as 60 dB. The processor can determine, based on the data generated by both sensors, that the processor should activate all of the lights in the room. In the event the processor only received data from the ambient light sensor, the processor may not have any basis to alter the state of the lighting in the room. Similarly, if the processor only received data from the microphone, it may not make sense to activate the lights in the room because it is daytime or bright in the room (e.g., the lights are already on). As another example, two or more sensors can communicate with one another. Thus, data generated by multiple sensors simultaneously or nearly simultaneously can be used to determine a state of an environment and, based on the determined state, generate a response.

Data generated by one or more sensors can indicate patterns in the behavior of one or more users and/or an environment state over time, and thus can be used to "learn" such characteristics. For example, data generated by an ambient light sensor in a room and the time of day can be stored in a local or remote storage medium. A processor in communication with the storage medium can compute a behavior based on the data generated by the light sensor. The light sensor data can indicate that the amount of light detected increases until an approximate time or time period, such as 3:30 PM, and then declines until another approximate time or time period, such as 5:30 PM, at which time there an abrupt increase in the amount of light is detected. In many cases, the amount of light detected after the second time period can be either below a dark level of light (e.g., under or equal to 60 lux) or bright (e.g., equal to or above 400 lux). In this example, the data can indicate that after 5:30 PM, an occupant is turning on/off a light as the occupant of the room in which the sensor is located enters/leaves the room. At other times, the light sensor data can indicate that no lights are turned on/off in the room. The system, therefore, can learn that occupants patterns of turning on and off lights, and can generate a response to the learned behavior. For example, at 5:30 PM, a smart home environment or other sensor network can automatically activate the lights in the room if the smart home environment or the other sensor network detects an occupant in proximity to the home. In some examples, such behavior patterns can be verified using other sensors. Continuing the example, user behavior regarding specific lights can be verified and/or further refined based upon states of, or data gathered by, smart switches, outlets, lamps, motion sensors, and the like.

Sensors can communicate via a communication network, such as a conventional wireless network, and/or a sensor-specific network through which sensors can communicate with one another and/or with dedicated other devices. In some configurations one or more sensors can provide information to one or more other sensors, to a central controller, or to any other device capable of communicating on a network with the one or more sensors. A central controller can be general- or special-purpose. For example, one type of central controller is a home automation network, which collects and analyzes data from one or more sensors within the home. Another example of a central controller is a special-purpose controller which is dedicated to a subset of functions, such as a security controller which collects and analyzes sensor data primarily or exclusively as the sensor data relates to various security considerations for a location. A central controller can be located locally with respect to the sensors with which the central controller communicates and from which the central controller obtains sensor data, such as in the case where the central controller is positioned within a home that includes a home automation and/or sensor network. Alternatively or in addition, a central controller can be remote from the sensors, such as where the central controller is implemented as a cloud-based system which communicates with multiple sensors, which can be located at multiple locations and can be local or remote with respect to one another.

The controller 708 can be a general- or special-purpose computer. The controller can, for example, receive, aggregate, and/or analyze environmental information received from the sensors 702, 704. The sensors 702, 704 and the controller 708 can be located locally to one another, such as within a single dwelling, office space, building, room, or the like, or they can be remote from each other, such as where the controller 708 is implemented in the remote system 710 such as a cloud-based reporting and/or analysis system. Alternatively or in addition, sensors can communicate directly with the remote system 710. The remote system 710 can, for example, aggregate data from multiple locations, provide instructions, provide software updates, and/or provide aggregated data to the controller 708 and/or the sensors 702, 704.

The sensor network 700 can be implemented in a smart-home environment. The smart-home environment can include a structure, a house, office building, garage, mobile home, or the like. Devices in the smart home environment, such as the sensors 702, 704, the controller 708, and the network 706 can be integrated into a smart-home environment that does not include an entire structure, such as an apartment, a condominium, an office space, the like, or a combination thereof. The smart home environment can control and/or be coupled to devices outside of the structure. For example, one or more of the sensors 702, 704 can be located outside the structure, for example, at one or more distances from the structure. One or more of the devices in the smart home environment need not be located within the structure. For example, the controller 708, which can receive input from the sensors 702, 704, can be located outside of the structure. The structure can include a plurality of rooms, separated at least partly from each other via walls. The walls can include interior walls or exterior walls. Each room can further include a floor and a ceiling. Devices, such as the sensors 702, 704, can be mounted on, integrated with, and/or supported by a wall, floor, or ceiling of the structure.

The sensor network 700 can include a plurality of devices, including intelligent, multi-sensing, network-connected devices, which can integrate seamlessly with each other and/or with a central server or a cloud-computing system (e.g., the controller 708 and/or the remote system 710) to provide home-security and smart-home features. The smart-home environment can include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells can be the sensors 702, 704 shown in FIG. 7.

As another example, a smart doorbell can control doorbell functionality, detect a person's approach to or departure from a location (e.g., an outer door to the structure), and announce a person's approach or departure from the structure via audible and/or visual message output by a speaker and/or a display coupled to, for example, the controller 708.

In some examples, the sensor network 700 can include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs can be or include one or more of the sensors 702, 704 shown in FIG. 7. A smart wall switch can detect ambient lighting conditions, and control a power and/or dim state of one or more lights. For example, a sensor such as sensors 702, 704, can detect ambient lighting conditions, and a device such as the controller 708 can control the power to one or more lights (not shown) in the smart-home environment. Smart wall switches can also control a power state or speed of a fan, such as a ceiling fan. For example, sensors 702, 704 can detect the power and/or speed of a fan, and the controller 708 can adjust the power and/or speed of the fan, accordingly. Smart wall plugs can control supply of power to one or more wall plugs (e.g., such that power is not supplied to the plug if nobody is detected to be within the smart-home environment). For example, one of the smart wall plugs can control supply of power to a lamp (not shown).

In examples of the disclosed subject matter, a smart-home environment can include one or more intelligent, multi-sensing, network-connected entry detectors (e.g., "smart entry detectors"). Such detectors can be or include one or more of the sensors 702, 704 shown in FIG. 8. The illustrated smart entry detectors (e.g., sensors 702, 704) can be disposed at one or more windows, doors, and other entry points of the smart-home environment for detecting when a window, door, or other entry point is opened, broken, breached, and/or compromised. The smart entry detectors can generate a corresponding signal to be provided to the controller 708 and/or the remote system 710 when a window or door is opened, closed, breached, and/or compromised. In some examples of the disclosed subject matter, the alarm system, which can be included with the controller 708 and/or coupled to the network 706 may not arm unless all smart entry detectors (e.g., sensors 702, 704) indicate that all doors, windows, entryways, and the like are closed and/or that all smart entry detectors are armed.

The smart doorbells, the smart wall switches, the smart wall plugs, the smart entry detectors, the keypads, and other devices of a smart-home environment (e.g., as illustrated as sensors 702, 704 of FIG. 7 can be communicatively coupled to each other via the network 707, and to the controller 708 and/or the remote system 710 to provide security, safety, and/or comfort for a user in the smart home environment).

A user can interact with one or more of the network-connected smart devices (e.g., via the network 706). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key Fobs with the smart-home environment (e.g., with the controller 708). Such registration can be made at a central server (e.g., the controller 708 and/or the remote system 710) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user can also use their registered electronic device to control the network-connected smart devices when the user is located inside the smart-home environment.

Alternatively, or in addition to registering electronic devices, the smart-home environment can make inferences about which individuals live in the home and are therefore users and which electronic devices are associated with those individuals. As such, the smart-home environment can "learn" who is a user (e.g., an authorized user) and permit the electronic devices associated with those individuals to control the network-connected smart devices of the smart-home environment (e.g., devices communicatively coupled to the network 706), in some examples including sensors used by or within the smart-home environment. Various types of notices and other information can be provided to users via messages sent to one or more user electronic devices. For example, the messages can be sent via email, short message service (SMS), multimedia messaging service (MMS), unstructured supplementary service data (USSD), the like, any other practicable type of messaging services and/or communication protocols, or a combination thereof.

A smart-home environment can include communication with devices outside of the smart-home environment but within a proximate geographical range of the home. For example, the smart-home environment can include an outdoor lighting system (not shown) that communicates information through the communication network 706 or directly to a central server or cloud-computing system (e.g., the controller 708 and/or the remote system 710) regarding detected movement and/or presence of people, animals, and any other objects and receives back commands for controlling the lighting accordingly.

The controller 708 and/or the remote system 710 can control the outdoor lighting system based on information received from the other network-connected smart devices in the smart-home environment. For example, in the event, any of the network-connected smart devices, such as smart wall plugs located outdoors, detect movement at night time, the controller 708 and/or the remote system 710 can activate the outdoor lighting system and/or other lights in the smart-home environment.

In some configurations, the remote system 710 can aggregate data from multiple locations, such as multiple buildings, multi-resident buildings, and individual residences within a neighborhood, multiple neighborhoods, and the like. In general, multiple controllers 708 can provide information to the remote system 710. The multiple controllers 708 can provide data directly from one or more sensors as previously described, or the data can be aggregated and/or analyzed by local controllers such as the controller 708, which then communicates with the remote system 710. The remote system can aggregate and analyze the data from multiple locations, and can provide aggregate results to each location. For example, the remote system 710 can examine larger regions for common sensor data or trends in sensor data, and provide information on the identified commonality or environmental data trends to each of the multiple controllers 708.

Figure 8:
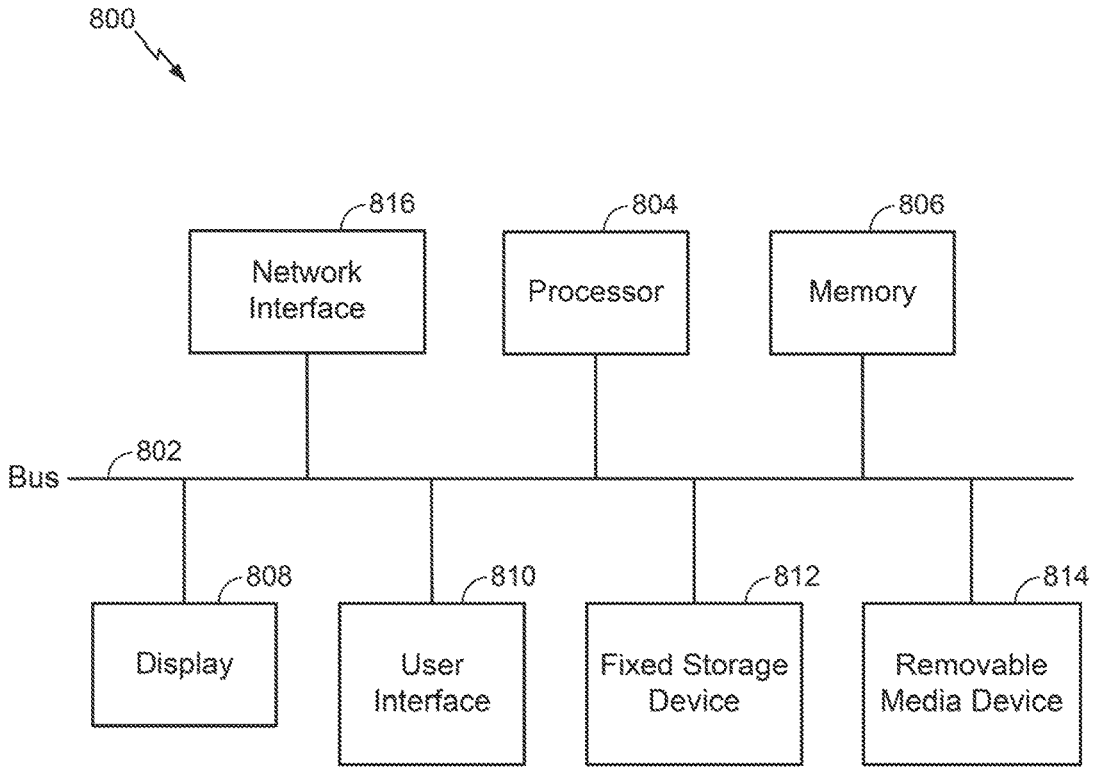
FIG. 8 shows a computing device, according to an example of the disclosed subject matter.

FIG. 8 depicts an example computing device 800 configured to implement examples of the disclosed subject matter. The device 800 can be configured as a control device (e.g., as the controller 708, the remote system 710, the like, or a combination thereof). The device 800 can be configured as a device including sensors (e.g., the sensors 702, 704). Alternatively or in addition, the device 800 can be, for example, a desktop or laptop computer, or a mobile computing device such as a smart phone, tablet, or the like. The device 800 can include a bus 802 configured to enable data communication between couple major components of the device 800, such as the processor 804, a memory 806, a display 808 such as a display screen, a user interface 810, a fixed storage device 812, a removable media device 814, a network interface 816, the like, or a combination thereof.

The processor 804 can be a general purpose processor and/or an ASIC. In an example, the processor 804 can be configured in a manner similar to, or identical to, the processor 106.

The memory 806 can be a RAM, a ROM, flash RAM, a computer-readable storage medium, the like, or a combination thereof.

The user interface 810 can be configured to couple to one or more controllers. The user interface 810 can be configured to couple to one or more user input devices, such as a keyboard, a mouse, a touch screen, the like, or a combination thereof.

The fixed storage device 812 can be a hard drive, a flash memory device, the like, or a combination thereof. The fixed storage device 812 can be integral with the device 800 or can be separate and accessed through an interface.

The removable media device 814 can be an optical disk, flash drive, the like, or a combination thereof.

The network interface 816 can be configured to communicate with one or more remote devices (e.g., sensors such as the sensors 702, 704) via a suitable network connection. The network interface 816 can be configured to provide a connection to a remote server via a wired or wireless connection. The network interface 816 can provide the connection using any suitable technique and protocol as will be readily understood by one of skill in the art, including digital cellular telephone, Wi-Fi, Bluetooth(R), NFC, the like, or a combination thereof. For example, the network interface 816 can allow the device to communicate with other computers via one or more local, wide-area, or other communication networks, as described in further detail herein.

Figure 9:
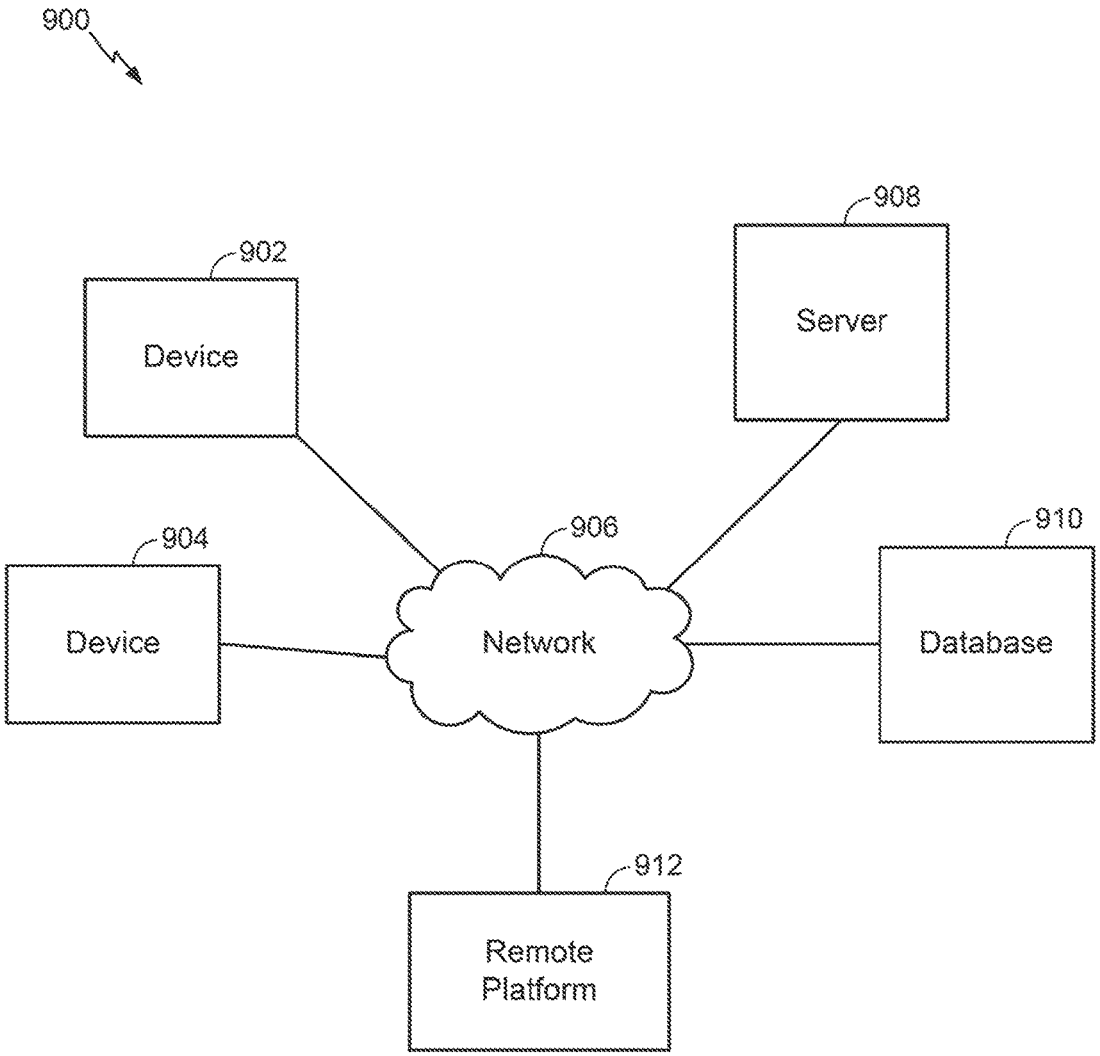
FIG. 9 shows an example network, according to an example of the disclosed subject matter.

FIG. 9 shows an example network 900. The network 900 can include one or more devices 902, 904. The devices 902, 904 can be as a computer, a computing device, a smart phone, a tablet computing device, the like, or a combination thereof. The devices 902, 904 can couple to other devices via one or more networks 906. The network 906 can be a local network, wide-area network, the Internet, or any other suitable communication network or networks. The network 906 can be implemented on any suitable platform including wired and/or wireless networks. The devices 902, 904 can communicate with one or more remote devices, such as the server 908 and/or a database 910. The remote devices, such as a server 908 and/or a database 910 can be directly accessible by the devices 902, 904, or one or more other devices can provide intermediary access such as where the server 908 provides access to resources stored in the database 910. The devices 902, 904 also can access the remote platform 912 or services provided by the remote platform 912 such as cloud computing arrangements and services. The remote platform 912 can include the servers 908 and/or the database 910.

The term "example" can mean "serving as an example, instance, or illustration." Any example described as "example" is not necessarily to be construed as preferred over other examples. Likewise, the term "examples" does not require that all examples include the described feature, advantage, or operation. Use of the terms "in one example," "an example," and the like does not necessarily refer to the same example. Use of the terms "in one feature," "a feature," and the like does not necessarily refer to the same feature. Furthermore, a particular feature can be combined with one or more other features. Moreover, a particular structure can be combined with one or more other structures. At least a portion of the apparatus described hereby can be configured to perform at least a portion of a method described hereby.

The terms "connected," "coupled," and variations thereof, mean any connection or coupling between elements, either direct or indirect, and can include an intermediate element between two elements that are "connected" or "coupled" together via the intermediate element. Coupling and connection between the elements can be physical, logical, or a combination thereof. Elements can be "connected" or "coupled" together, for example, by one or more wires, cables, printed electrical connections, electromagnetic energy, the like, or a combination thereof. The electromagnetic energy can have a wavelength at a radio frequency, a microwave frequency, a visible optical frequency, an invisible optical frequency, the like, or a combination thereof, as is practicable. These are non-limiting and non-exhaustive examples.

The term "signal" can include any signal such as a data signal, an audio signal, a video signal, a multimedia signal, an analog signal, a digital signal, the like, or a combination thereof. Information and signals can be represented using any of a variety of different technologies and techniques. For example, data, an instruction, a process step, a process block, a command, information, a signal, a bit, a symbol, the like, or a combination thereof can be represented by a voltage, a current, an electromagnetic wave, a magnetic field, a magnetic particle, an optical field, an optical particle, the like, or any practical combination thereof, depending at least in part on the particular application, at least in part on a desired design, at least in part on corresponding technology, at least in part on like factors, or a combination thereof.

An element referred to as "first," "second," and so forth does not limit either the quantity or the order of those elements. Rather, these designations are used as a convenient method of distinguishing between two or more elements or instances of an element. Thus, a reference to first and second elements does not mean that only two elements can be employed, or the first element must necessarily precede the second element. Also, unless stated otherwise, a set of elements can comprise one or more elements. In addition, terminology of the form "at least one of: A, B, or C" or "one or more of A, B, or C" or "at least one of a group consisting of A, B, and C" can be interpreted as "A or B or C or any combination of these elements." For example, this terminology can include A, or B, or C, or A and B, or A and C, or A and B and C, or 2A, or 2B, or 2C, and so on.

The terminology used herein describes particular examples and is not intended to be limiting. The singular forms "a," "an," and "the" include the plural forms as well, unless the context clearly indicates otherwise. In other words, the singular portends the plural, where practicable. Further, the terms "comprises," "comprising," "includes," and "including" specify a presence of a feature, an integer, a step, a block, an operation, an element, a component, the like, or a combination thereof, but do not necessarily preclude a presence or an addition of another feature, integer, step, block, operation, element, component, and the like.

Further, the example logical blocks, modules, circuits, steps, and the like, as described in the examples disclosed hereby, can be implemented as electronic hardware, computer software, or a combination of both, as is practicable. To clearly illustrate this interchangeability of hardware and software, example components, blocks, modules, circuits, and steps are described herein generally in terms of their functionality. Whether the functionality is implemented as hardware or software depends upon the particular application and design constraints imposed on an overall system. Skilled artisans can implement the described functionality in a manner tailored to a particular application. An implementation should not be interpreted as causing a departure from the scope of the present disclosure.

One or more examples provided hereby can include a non-transitory (i.e., a non-transient) machine-readable media and/or a non-transitory (i.e., a non-transient) computer-readable media storing processor-executable instructions (e.g., special programming) configured to cause a processor (e.g., a special-purpose processor) to transform the processor and any other cooperating devices into a machine (e.g., a special-purpose processor) configured to perform at least a part of a function described hereby and/or a method described hereby. Performing at least a part of a function described hereby can include initiating at least a part of a function described hereby. When implemented on a general-purpose processor, the processor-executable instructions can configure the processor to become a special-purpose device, such as by temporary (and/or permanent) creation of specific logic circuits within the processor, as specified by the instructions. In an example, a combination of at least two related method steps forms a sufficient algorithm. In an example, a sufficient algorithm constitutes special programming. In an example, any software that can cause a computer (e.g., a general-purpose computer, a special-purpose computer, etc.) to be configured to perform one or more function, feature, step algorithm, block, or combination thereof, constitutes special programming. A non-transitory (i.e., a non-transient) machine-readable media specifically excludes a transitory propagating signal. A non-transitory (i.e., a non-transient) machine-readable medium can include a hard drive, a universal serial bus drive, a RAM, a flash memory, a ROM, an erasable programmable read-only memory (EPROM), an electrically erasable programmable read-only memory (EEPROM), a register, a hard disk drive, a removable disk, a compact disc read-only memory (CD-ROM), the like. An example storage medium can be coupled to the processor such that the processor can read information from, and/or write information to, the storage medium. In an example, the non-transitory machine-readable medium can be integrated with a processor.

Further, examples are described in terms of sequences of actions to be performed by, for example, one or more element of a computing device, such as a processor. Examples can be implemented using hardware that can include a processor, such as a general purpose processor and/or an ASIC. Both a general purpose processor and an ASIC can be configured to initiate and/or perform at least a part of the disclosed subject matter. The processor can be coupled to a memory, such as a RAM, a flash memory, a ROM, an EPROM, an EEPROM, the like, or any other device capable of storing electronic information, such as a processor-executable instruction.

Nothing stated or depicted in this application is intended to dedicate any component, step, block, feature, object, benefit, advantage, or equivalent to the public, regardless of whether the component, step, block, feature, object, benefit, advantage, or the equivalent is recited in the claims. This description, for purpose of explanation, includes references to specific examples. However, the illustrative discussions herein (including in the claims) are not intended to be exhaustive or to limit examples of the disclosed subject matter to the precise forms disclosed. Many modifications and variations are possible in view of the teachings herein. The examples are chosen and described in order to explain the principles of examples of the disclosed subject matter and their practical applications, to thereby enable persons skilled in the art to utilize those examples as well as various examples with various modifications as may be suited to the particular use contemplated.

The invention claimed is:

1. A method, comprising:

receiving neural network training data which is auralized with respect to a specific device;

receiving an auralized multi-microphone recording, wherein the auralized multi-microphone recording is auralized with respect to the specific device which is not a simulated human head;

receiving a binaural recording, wherein the binaural recording is captured using a simulated human head;

applying the neural network training data to a neural network;

creating a binaural output by device-shaping the received auralized multi-microphone recording with the neural network, wherein the binaural output is auralized with respect to a human listener;

comparing the binaural output with the binaural recording to identify differences; and generating the neural network training data using the identified differences.

2. The method of claim 1, wherein the neural network weighs and combines components of the auralized multi-microphone recording to create the binaural output.

3. The method of claim 1, wherein the neural network training data includes at least one selected from the group consisting of: data describing effects on recorded sound by rooms of varying sizes, data describing reverberation times, and data generated by an auralization simulator.

4. The method of claim 1, wherein the receiving the neural network training data includes receiving the neural network training data from a cloud-computing storage device, receiving the auralized multi-microphone recording from the cloud-computing storage device, or both.

5. The method of claim 1, wherein the receiving of the auralized multi-microphone recording comprises receiving the auralized multi-microphone recording from a live stream.

6. The method of claim 1, wherein the receiving of the auralized multi-microphone recording comprises receiving the auralized multi-microphone recording from a storage device.

7. The method of claim 1, further comprising sending the binaural output to a binaural sound-reproducing device.

8. The method of claim 7, wherein the binaural sound-reproducing device comprises a pair of headphones.

9. A non-transitory computer-readable medium, comprising:

instructions stored by the non-transitory computer-readable medium, wherein the instructions are configured to cause a processor to:

initiate receiving neural network training data which is auralized with respect to a specific device;

initiate receiving an auralized multi-microphone recording, wherein the auralized multi-microphone recording is auralized with respect to the specific device which is not a simulated external human head;

initiate receiving a binaural recording, wherein the binaural recording is captured using a simulated human head;

initiate applying the neural network training data to a neural network;

initiate creating a binaural output by device-shaping the received auralized multi-microphone recording with the neural network, wherein the binaural output is auralized with respect to a human listener;

initiate comparing the binaural output with the binaural recording to identify differences; and initiate generating the neural network training data using the identified differences.

10. The non-transitory computer-readable medium of claim 9, wherein the instructions configured to cause the processor to initiate creating the binaural output comprise instructions configured to cause the processor to weigh and combine components of the auralized multi-microphone input to create the binaural output.

11. The non-transitory computer-readable medium of claim 9, wherein the instructions are further configured to cause the processor to:

send the binaural output to a binaural sound-reproducing device.

12. The non-transitory computer-readable medium of claim 11, wherein the binaural sound-reproducing device comprises a pair of headphones.

13. The non-transitory computer-readable medium of claim 9, wherein the instructions configured to cause the processor to receive the neural network training data comprise instructions configured to cause the processor to receive the neural network training data from a storage device.

14. The non-transitory computer-readable medium of claim 13 wherein the storage device comprises a cloud-computing storage device.

15. The non-transitory computer-readable medium of claim 9, wherein the instructions configured to cause the processor to receive the auralized multi-microphone recording comprise instructions configured to cause the processor to receive the auralized multi-microphone recording from a live stream.

16. The non-transitory computer-readable medium of claim 9, wherein the instructions configured to cause the processor to receive the auralized multi-microphone recording comprise instructions configured to cause the processor to receive the auralized multi-microphone recording from a storage device.

17. The non-transitory computer-readable medium of claim 16, wherein the storage device comprises a cloud-computing storage device.

18. The method of claim 1, wherein the identified differences include differences in one or more notch frequencies occurring at a substantially similar direction.

19. The non-transitory computer-readable medium of claim 9, wherein the identified differences include differences in one or more notch frequencies occurring at a substantially similar direction.

20. The method of claim 1, wherein the neural network adjusts a neural network coefficient in the neural network training data to reduce the identified differences.

21. The non-transitory computer-readable medium of claim 9, wherein the neural network adjusts a neural network coefficient in the neural network training data to reduce the identified differences.

* * * * *